US006582047B2

(12) United States Patent
Koitabashi et al.

(10) Patent No.: US 6,582,047 B2
(45) Date of Patent: Jun. 24, 2003

(54) INK JET PRINTING APPARATUS AND INK JET PRINTING METHOD

(75) Inventors: Noribumi Koitabashi, Kanagawa (JP); Hitoshi Yoshino, Kanagawa (JP); Masataka Yashima, Tokyo (JP); Hiroyuki Ogino, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/987,295

(22) Filed: Nov. 14, 2001

(65) Prior Publication Data

US 2002/0097290 A1 Jul. 25, 2002

(30) Foreign Application Priority Data

Nov. 17, 2000 (JP) ..... 2000/352007

(51) Int. Cl.[7] ..... B41J 29/38; B41J 29/393
(52) U.S. Cl. ..... 347/16; 347/19
(58) Field of Search ..... 347/16, 19, 96, 347/105, 14, 23, 43, 12, 10, 11, 8, 9, 15, 17; 428/304.4

(56) References Cited

U.S. PATENT DOCUMENTS

| | | | | |
|---|---|---|---|---|
| 4,540,996 A | * | 9/1985 | Saito | 347/43 |
| 5,294,942 A | * | 3/1994 | Loewenthal et al. | 347/16 |
| 5,635,291 A | | 6/1997 | Yoshino et al. | 428/304.4 |
| 5,679,451 A | | 10/1997 | Kondo et al. | 428/304.4 |
| 5,707,716 A | | 1/1998 | Yoshino et al. | 428/212 |
| 5,800,916 A | | 9/1998 | Yoshino et al. | 428/328 |
| 5,894,314 A | | 4/1999 | Tajika et al. | 347/14 |
| 5,955,185 A | | 9/1999 | Yoshino et al. | 428/304.4 |
| 5,965,252 A | | 10/1999 | Santo et al. | 428/329 |

FOREIGN PATENT DOCUMENTS

| | | |
|---|---|---|
| EP | 0 701 904 | 3/1996 |
| EP | 0 736 392 | 10/1996 |
| EP | 0 967 088 | 12/1999 |

(List continued on next page.)

OTHER PUBLICATIONS

J. Roček, et al., "Porous structure of aluminum hydroxide and its content of pseudoboehmite," Applied Catalysis, vol. 74, 1991, pp. 29–36.

*Primary Examiner*—John Barlow
*Assistant Examiner*—Charles W. Stewart, Jr.
(74) *Attorney, Agent, or Firm*—Fitzpatrick, Cella, Harper & Scinto

(57) ABSTRACT

A printing apparatus which uses a printing medium, which can retain a large amount of coloring material near its surface and can cause ink solvent to permeate rapidly, and can perform printing in a printing mode that is suitable for the above-mentioned printing medium, is provided. Furthermore, a user friendly printing apparatus is realized. More specifically, the printing mode for the above-mentioned printing medium is a mode that uses less ink ejection per one pixel. Even in this case, high speed printing based on printing of sufficient density and high ink absorption become possible. Furthermore, even in the case printing is made on ordinary paper, a lesser ink ejection amount in the same printing mode is performed, but since this printing mode uses processing liquid that makes the ink insoluble, in a similar way, printing of sufficient density and high speed printing becomes possible.

30 Claims, 9 Drawing Sheets

U.S. PATENT DOCUMENTS

| | | | |
|---|---|---|---|
| EP | 1 002 656 | 5/2000 | |
| JP | 51-38298 | 3/1976 | |
| JP | 56-120508 | 9/1981 | |
| JP | 1-141783 | 6/1989 | |
| JP | 4-202011 | 7/1992 | |
| JP | 5-16015 | 3/1993 | |
| JP | 8-132731 | 5/1996 | |
| JP | 8-174993 | 7/1996 | |
| JP | 9-66664 | 3/1997 | ..... 347/16 |
| JP | 9-76628 | 3/1997 | |
| JP | 9-86035 | 3/1997 | |
| JP | 9-99627 | 4/1997 | |
| JP | 2714350 | 10/1997 | |
| JP | 2714351 | 10/1997 | |
| JP | 2714352 | 10/1997 | |
| JP | 11-174718 | 7/1999 | |
| JP | 2000-79755 | 3/2000 | |
| JP | 2000-211250 | 8/2000 | |

* cited by examiner

INK JET PRINTING APPARATUS AND INK JET PRINTING METHOD

This application is based on Patent Application No 2000-352007 filed Nov. 17, 2000 in Japan, the content of which is incorporated hereinto by reference.

BACKGROUND OF THE INVENTION

1. Field of the Invention

The present invention relates to an ink jet printing apparatus and an ink jet printing method, specifically, to an ink jet printing apparatus and an ink jet printing method that can perform printing in a printing mode which takes a printing characteristic of a printing medium such as a printing paper, as a condition on performing printing.

2. Description of the Related Art

An ink jet printing system possesses various advantages such as enabling a printing operation with low noise, low running cost, and high speed, as well as ease of making an apparatus small and of making an apparatus have coloring function, and then the system is broadly used in printers and copying machines or the like.

In this kind of printing apparatus based on the ink jet system, achieving both high-speed printing and high-density printing simultaneously has been a conventional and main issue. For instance, in the case of ink jet printer, a mode that performs printing of relatively high speed, which is called draft mode, is well known. This mode performs printing rather at the expense of a print quality more or less. Specifically, printing dots are thinned out at a specified rate. Accompanying this, a scanning speed of a printing head or feeding speed of a printing medium to the printing head is made larger. In the case of such high-speed printing based on thinning out, a total area that the ink dots occupy in the printing medium becomes small, and then the printed density that is realized is not so high.

On the other hand, from the standpoint of printing characteristics of the printing medium used in the printing, various proposals that contribute to the above-mentioned high-speed printing and high-density printing have been made. Generally speaking, in order to achieve high density, it is important to fix the coloring material such as dye in ink at the shallow portion near the surface of the printing medium as much as possible. On the other hand, for high-speed printing, in order to promote rapid fixing of ink, a high absorption property of the printing medium is required. However, in such a case, the coloring material of the ink will easily penetrate deeply into the printing medium in the thickness direction, and the amount of coloring material that remain on the surface will become small. Consequently, high density will be difficult to be achieved. In this way, also owing to the printing characteristics of the printing medium, printing with both high-density and high-speed has difficulty to be realized.

As apparent from the above, the printing medium that is able to retain a lot of the coloring material near its surface, and make the solvent of ink rapidly permeate so that the fixation of ink becomes good is one of the features required for solving the aforementioned conventional and major issue.

Furthermore, it is desirable from the standpoint of improving the ease of using the apparatus to execute a printing mode suitable for such a special printing medium and then realize coexistence of high-density printing and high-speed printing, as well as to realize printing for other ordinarily used printing medium that compares favorably with the printing for the special printing medium under the same printing mode at high-density printing and high-speed printing. For instance, even in the case that a user tries to print a document mainly composed of characters and intentionally selects the ordinarily used paper instead of the above-mentioned special printing medium, or even in the case that the user makes a mistake in selecting the printing medium and uses the ordinarily used paper instead, if high density and high speed printing can be realized, it is possible to always perform preferable printing correspondingly to various users such as users who do not care about the type of printing medium used, or users who positively select printing medium that matches the printing image.

SUMMARY OF THE INVENTION

The object of the present invention is to provide an ink jet printing apparatus and an ink jet printing method that can perform printing at a printing mode suitable for using a printing medium, which can retain lots of coloring material near the surface of the printing medium and which is able to make a solvent of ink permeate rapidly, and that can make the printing apparatus used easily.

In the first aspect of the present invention, there is provided an ink jet printing apparatus, which performs printing by executing relative movement of a printing head to a printing medium and by during the relative movement ejecting at least ink from the printing head, performing printing in a printing mode selected from a plurality of printing modes which correspond to different printing medium and have different relative movement speeds of the printing head to the printing medium, respectively, the apparatus comprising:

head driving means for controlling the printing head to execute an ejection in a manner that for the printing mode having high relative movement speed, an ink ejection amount per one pixel is made smaller than that in the printing mode having lower relative movement speed than the high relative movement speed, and that in a case of printing black, black ink and a processing liquid that makes the ink insoluble are ejected.

Here, the printing mode having high relative movement speed may use the printing medium that contains substantially no sizing agent but contains alumina particles.

The printing mode having high relative movement speed may use the printing medium having a permeability of 5 ml $m^{-2}$ $msec^{-1/2}$ or above as Ka value in a case of using ink having a permeation property of 1 ml $m^{-2}$ $msec^{-1/2}$ or less as Ka value for PPC paper.

In the second aspect of the present invention, there is provided an ink jet printing apparatus, comprising:

a controller that can execute a high speed absorption paper printing mode using a high speed absorption paper, which contains substantially no sizing agent but contains alumina particles or which has a permeability of 5 ml $m^{-2}$ $msec^{-1/2}$ or above as Ka value in a case of using ink having a permeation property of 1 ml $m^{-2}$ $msec^{-1/2}$ or less as Ka value for PPC paper, and an ordinary paper printing mode using an ordinary paper, respectively as the printing mode, wherein an ink ejection amount per one pixel is made small for the high speed absorption paper printing mode than that for the ordinary paper printing mode.

In the third aspect of the present invention, there is provided an ink jet printing method, which performs printing by executing relative movement of a printing head to a printing medium and by during the relative movement ejecting at least ink from the printing head, performing printing in a printing mode selected from a plurality of printing modes which correspond to different printing media and have different relative movement speeds of the printing head to the printing medium, respectively, the method comprising the step:

controlling the printing head to execute an ejection in a manner that for the printing mode having high relative movement speed, an ink ejection amount per one pixel is made smaller than that in the printing mode having lower relative movement speed than the high relative movement speed, and that in a case of printing black, black ink and a processing liquid that makes the ink insoluble are ejected.

Here, the printing mode having high relative movement speed may use the printing medium that contains substantially no sizing agent but contains alumina particles.

The printing mode having high relative movement speed may use the printing medium having a permeability of 5 ml $m^{-2}$ msec $^{-1/2}$ or above as Ka value in a case of using ink having a permeation property of 1 ml $m^{-2}$ $msec^{-1/2}$ or less as Ka value for PPC paper.

In the fourth aspect of the present invention, there is provided an ink jet printing method, comprising:

a printing step for executing a high speed absorption paper printing mode using a high speed absorption paper, which contains substantially no sizing agent but contains alumina particles or which has a permeability of 5 ml $m^{-2}$ $msec^{-1/2}$ or above as Ka value in a case of using ink having a permeation property of 1 ml $m^{-2}$ $msec^{-1/2}$ or less as Ka value for PPC paper, and an ordinary paper printing mode using an ordinary paper, respectively as the printing mode, wherein an ink ejection amount per one pixel is made small for the high speed absorption paper printing mode than that for the ordinary paper printing mode.

According to the above structure, when executing the plurality of printing modes having different relative movement speeds, respectively, in the printing mode with higher relative movement speed, the amount of ink ejected per one pixel is made smaller than that in the printing mode with lower relative movement speed. In addition to this, at least in the case of printing black, black ink and a processing liquid that makes the black ink insoluble are ejected from the printing head. Preferably, in the printing mode with higher relative movement speed, a printing medium containing substantially no sizing agent but containing alumina particles, or a printing medium having a permeableness or permeability of 5 ml $m^{-2}$ $msec^{-1/2}$ or above for Ka value in a condition of using ink having a permeability to PPC paper of 1 ml $m^{-2}$ $msec^{-1/2}$ or less for Ka value, that is, a high speed absorption paper is used. Thereby, even when the amount of ink landing on the printing medium is small, most of the ink coloring material will be retained on the surface layer of the printing medium, and the solvent of the ink will permeate rather rapidly. Consequently, the above printing mode can realize printing with high density and high speed. On the other hand, even when the above-mentioned high speed absorption paper is not used but the printing paper such as ordinary paper is used, since the processing liquid that makes the ink insoluble is used, similar to the above case, a lot of coloring material can be retained on the surface layer of the printing medium, and a printing having high density can be achieved.

DETAIL DESCRIPTION OF THE PREFERRED EMBODIMENTS

The embodiments of the present invention will be described by referring to the attached drawings in detail below.

The one embodiment of the present invention is featured in, firstly, the printing characteristics of a printing medium. More specifically, the embodiment is featured in using a printing paper having an ink absorption property in which solvent of ink is rapidly absorbed and a property which make pigment or dye as a coloring material for the ink retained at the relatively shallow portion. Concretely speaking, in the case this printing paper is used, the ink will spread along the surface of the printing paper, so that, in comparison with the amount of a landing ink droplet, a dot formed therefrom has a larger diameter, as well as, the coloring material does not penetrate in a depth direction of the printing paper but is retained at a rather shallow portion in a surface layer of the printing paper. Thereby, high density of printing can be realized. On the other hand, the solvent of ink can penetrate rapidly in a thickness direction of the printing paper and then high fixation is shown.

Figure 1:
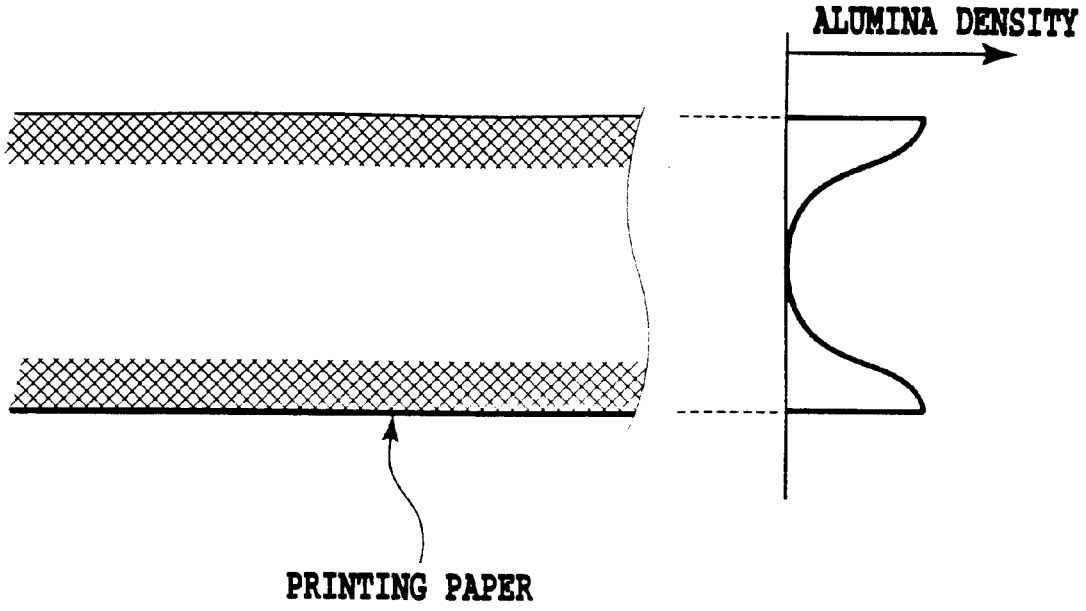
FIG. 1 is a diagram showing distribution of alumina impregnation in the surface layer of a printing medium according to one embodiment of the present invention.

The printing paper that can realize the above-described printing characteristics (hereinafter referred to as the "high speed absorption paper" is proposed by the inventors of the present application. An outline of its structure is as shown in FIG. 1 that alumina is impregnated into the shallow portion of the printing paper surface. In an example of FIG. 1 the alumina is impregnated into both surfaces of the printing paper, but alumina may be impregnated into at least the surface of the side on which the ink is to be ejected.

As for the structure of this high speed absorption paper, as mentioned later, on the surface of the fibers that compose the ordinary printing paper, alumina particles are adsorbed, and a sizing agent, which is normally used for a printing paper from the view of preventing bleeding, is not used at all, or even if it is used, only in traces. In this case, since no sizing agent is used or used only in traces, the ink can permeate easily in all directions. As a result of this, the ink will spread along the surface of the printing paper, and a large dot can be formed in comparison with the amount of ink. In addition to this, since alumina particles exist on the surface, the pigment or dye of ink is adsorbed by the fibers via the alumina particles, and most of these coloring materials can be retained on the surface layer of the printing paper.

On the other hand, since either no sizing agent is used or only a limited amount is used in comparison with the normal printing paper, the space among fibers that are normally plugged by the sizing agent will remain as it is as empty space, and then the ink solvent can permeate in the direction of the printing paper thickness through such spaces. As a result, this high speed absorption paper can have a high ink absorption property or a high ink fixation property. As mentioned later, in the case of measurements based on the Bristow method, even in the case that ink having low permeability for an ordinary printing paper used for copying, such as the so-called overlay type ink, is used, the printing paper of the present embodiment shows high ink absorption speed equivalent to a Ka value of about 5 ml $m^{-2}$ $msec^{-1/2}$ or above.

(Embodiments of the High Speed Absorption Paper)

A detailed description will be given on the high speed absorption paper related to one of the embodiments of the present invention. The paper surface of the high-speed absorption paper of the present embodiment has a feeling similar to ordinary paper, and in addition, as mentioned above, the absorption of ink solvent is good, and it also possesses the characteristic of high optical concentration of the printing region based on ink. Furthermore, the so called powder falling and curling do not occur so much, and it is a printing medium with excellent water resistance.

The inventors of the present patent application proposed a printing medium containing hydrated alumina in the fibrous materials in official gazettes of Japanese Patent No. 2714350—Patent No-2714352, respectively, and Japanese Patent Application Laid-open No. 9-99627 and Japanese Patent Application Laid-open No. 2000-211250. The printing medium disclosed in each gazette of Japanese Patent No. 2714350-Patent No. 2714352, and Japanese Patent Application Laid-open No. 9-99627 relates to printing medium containing hydrated alumina showing specific physical values. In this invention, even in the case of un-coated paper, we found that excellent coloring can be obtained. Furthermore, the printing medium disclosed in the Japanese Patent Application Laid-open No. 2000-211250 is a medium of multi-layer composition consisting of the surface layer and the base layer, and it is a printing medium that has hydrated alumina showing boehmite structure contained in only the surface layer. In the same invention, by making the printing medium that contains hydrated alumina a multi-layer composition, as well as making hydrated alumina contained only in the surface layer, and in addition, by composing the base layer with materials having good liquid absorption properties, we found that excellent coloring and resolution can be obtained at the time of high speed printing.

The printing medium of the present embodiment is an improvement of the above mentioned patents, and it was obtained through discovery that by improving the composition of the printing medium containing hydrated alumina, even in case of printing medium composed of single layer by using fibrous materials containing no fillers and making paper containing no sizing agent, and in addition, by making the hydrated alumina and cationic resin exist near the surface, excellent ink absorption and coloring as well as good dot reproducibility can be obtained This is particularly effective in case of performing printing with the super high speed printer using the so-called full line head or the like. It is further preferable to coat the hydrated alumina and the cationic resin on the paper containing no sizing agent on a machine.

The printing medium of the present embodiment has the above-mentioned single layer composition, and since on-machine coating of hydrated alumina and cationic resin is performed, it is possible to make the paper easily with ordinary paper making machine, and there is the advantage of improving the productivity significantly. In particular, there is the advantage of being able to conduct coating of both sides easily. As for the application of the present invention, the fibrous materials need not be restricted to paper. It can be applied to all sorts of forms using fibrous materials such as synthetic paper, cloth, and non-woven cloth using synthetic pulp. No sizing agent paper mentioned here means that the measurement of Stoeckigt sizing degree is 0 seconds. The measurement of Stoeckigt sizing degree can be performed by the method of JIS P-8122.

In other words, the printing medium of the present embodiment is chiefly composed of cellulose fiber of single layer composition containing no sizing agent, and in addition, the printing medium has hydrated alumina and cationic resin existing at least near the surface of the fibrous material containing no sizing agent. In this printing medium, the coloring material in the ink that has been ejected will be adsorbed near the surface, and the solvent components in the ink will be absorbed into the inside of the printing medium. By making no sizing agent paper that contains no fillers, excellent ink absorption speed can be obtained.

In the present embodiment, fibrous materials that do not contain any fillers are used, and in the spaces among the fibers of the fibrous materials there are no fillers, pigments, or resins. The reason is that by making spaces remain among the fibrous materials, the ink absorption is improved to the largest extent. Therefore, in the present embodiment, coating of normal resin components such as size press that is used for ordinary paper and cloth is not performed. To the surface of each fiber in the fibrous materials hydrated alumina and cationic resins exist.

Figure 2:
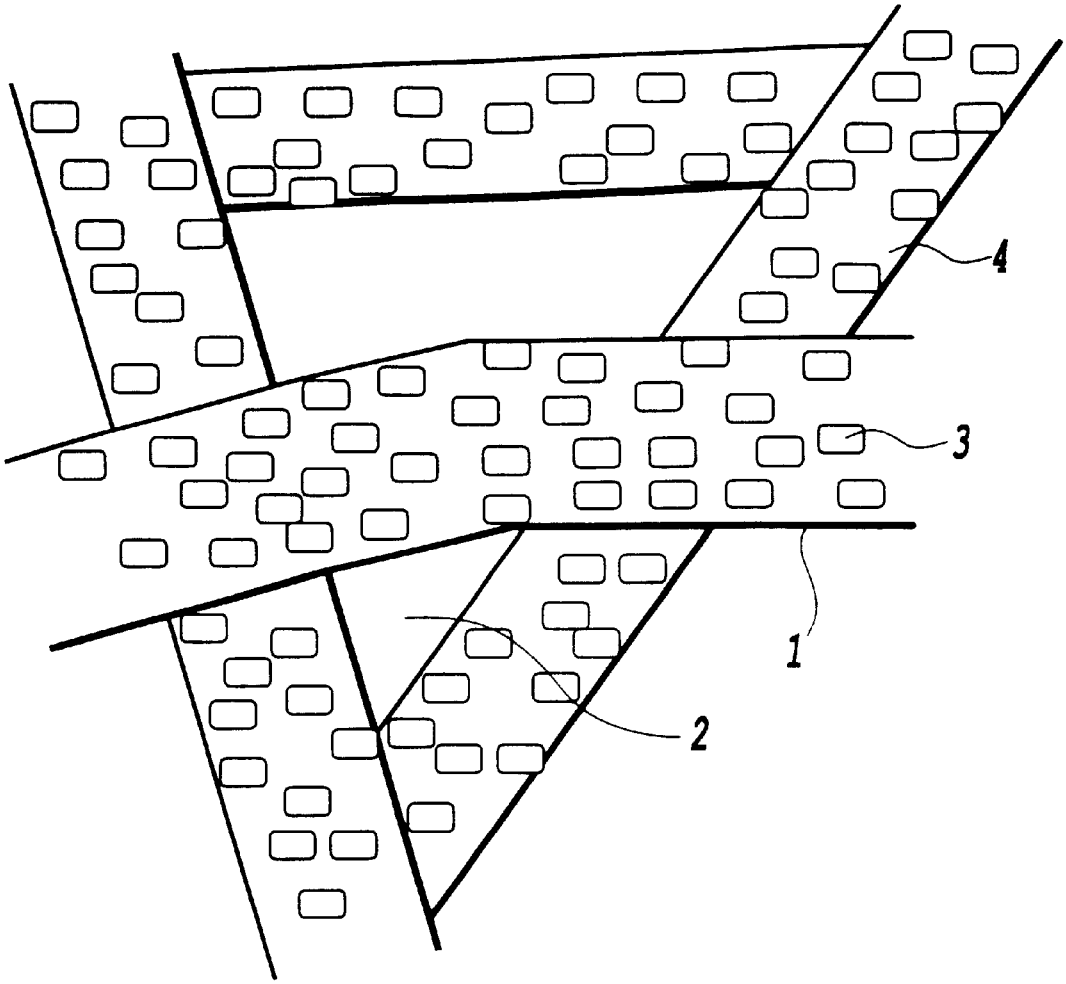
FIG. 2 is an illustration schematically showing a state in which alumina adheres to fibers that composes the printing medium.

As shown in FIG. 2, concretely speaking, hydrated alumina 3 and the cationic resin 4 exist in a manner in which they cover the surface of each fiber in the printing medium. In this case, it is necessary that the hydrated alumina and cationic resin do not fill up the spaces among each fiber of the fibrous materials.

In the present embodiment, make the hydrated alumina and cationic resin exist at least near the surface of the fibrous materials. As the addition method of hydrated alumina and cationic resin, it is desirable to coat the surface of the fibrous materials. By coating the hydrated alumina and cationic resin, it is possible to make more hydrated alumina and cationic resin exist near the surface of the fibrous materials, and as a result, improve the coloring. An even more preferable method is the method of conducting on-machine coating of hydrated alumina and cationic resin. In case on-machine coating is performed, it is possible to make the hydrated alumina and cationic resin exist only near the surface of the fibrous materials. Although the reason is not clear, in the case of on-machine coating, since the coating is performed immediately after making the paper, the chemical and physical activities of the fibrous materials are high, and it is surmised that the hydrated alumina and cationic resin that come into contact with the fibrous materials are fixed to them in a very short time after attachment.

The preferable coating amount is 1–5 $g/m^2$ for one side, respectively. In the present embodiment, since size coating is performed by the on-machine coating method, both sides are coated at the same time. In such a case, the coating amount of hydrated alumina and cationic resin is 2–10 $g/m^2$, respectively. By conducting on-machine coating, good coloring can be obtained with less coating amount while retaining the feeling of ordinary paper. Ordinary paper feeling mentioned here means that the cellulose fibers are exposed on the surface, and when felt with the hands, there is no feeling of fine particle coating. Furthermore, as described in Japanese Patent Application Laid-open No. 1-141783 and Japanese Patent Application Laid-open No. 11-174718, in the paper making process, in place of conducting size press coating on the cellulose fibers, continuous coating of hydrated alumina and cationic resin is performed by the on-machine method. In this case, a size press layer does not exist on the paper surface.

In Japanese Patent Application Laid-open 1-141783, an inkjet printing paper obtained by conducting on-machine coating of coating liquid containing amorphous silica and hydrated alumina having average particle sizes ranging between 5–200 nm at a weight ratio of 100:5–100:35 on base material, is disclosed. In this invention, with the purpose of improving the productivity of on-machine coating on the paper making machine, as binder of the amorphous silica, alumina sol is used. The printing medium in the present embodiment matches the above method in the point that on-machine coating is performed, but the coating composition is different from the one in which on-machine coating of hydrated alumina and cationic resin are made on no sizing agent paper like the present embodiment where fillers are not contained.

Furthermore, in the Japanese Patent Application Laid-open No. 11-174718, paper having pigment size coating made on one side of the base paper at the rate of 3–8 g/m$^2$, and information paper having finishing density in the range of 0.75–0.90 g/m$^2$, fiber alignment ratio in the range of 1.05–1.25, smoothness in the range of 50–120 seconds, and formation index at 20 or above is disclosed. In this invention, while maintaining the color image of the full color copier in a good state, the stiffness is maintained, and to prevent the deposited toner from entering the spaces of the paper when the density of the paper is lowered in order to lower the basis weight, pigment size coating is performed. Although the printing medium of the present embodiment coincides with the above in the point of conducting pigment size coating to the paper within the specified range, unlike the present embodiment, it does not describe the thought of conducting on-machine coating of hydrated alumina and cationic resin to no-filler paper that exhibits characteristics that satisfy properties such as ink absorption, coloring, and feeling of ordinary paper.

Since the hydrated alumina is positively charged, the fixation of coloring materials such as the dye in the ink is very good, and excellent coloring image can be obtained. In addition, problems such as browning of black ink, light fastness do not occur. Thus, it is preferable as material to be used for printing medium of the ink jet printing.

As hydrated alumina that exists in the printing medium of the present embodiment, hydrated alumina that shows a boehmite structure by the X ray diffraction method is the most desirable from the standpoint of ink absorption, coloring material absorption, and good coloring. Hydrated alumina is defined by the following general formula.

$$Al_2O_{3-n}(OH)_{2n}\cdot mH_2O$$

In the formula, n stands for one of the integers 0–3, m stands for a value of 0 through 10, preferably 0 through 5. The expression $mH_2O$ stands for a water phase which is unrelated to the crystal lattice and which makes elimination possible in most cases. Thus, m may be a figure other than an integer. Provided, however, that m and n cannot be 0 at the same time.

Generally speaking, the crystal of hydrated alumina that shows a boehmite structure is a layer structure compound of which its (020) plane forms a huge plane, and its X-ray diffraction drawing shows a peculiar diffraction peak. As boehmite structure, there are complete boehmite structure and quasi-boehmite structure that can also contain excess water between the layers of (020). This quasi-boehmite structure shows a broader diffraction peak than a complete boehmite structure, Since complete boehmite and quasi-boehmite cannot be clearly discriminated, in the present invention, unless there is special mention, hydrated alumina shall indicate boehmite structures including both types (hereinafter referred to as hydrated alumina).

As hydrated alumina of the boehmite structure used in the present embodiment, the ones that show the boehmite structure by the X-ray diffraction method are preferable from the standpoint of good color concentration, resolution, and ink absorption. In addition, if it is a hydrated alumina, hydrated alumina containing metal oxides such as titanium dioxide or silica may also be used.

As manufacturing method of the hydrated alumina used in the present embodiment, although it need not be restricted to this, if it is a manufacturing method that can produce hydrated alumina having boehmite structure, for instance, it can be produced by well-known methods such as hydrolysis of aluminum alkoxide or hydrolysis of sodium aluminate. Furthermore, as it is disclosed in the Japanese Patent Application Publication No. 56-120508, by heat treatment of amorphous hydrated alumina at 50° C. or above in the presence of water as in the manner of X-ray diffraction, it can be changed to boehmite structure and used.

There are no particular restrictions regarding the no-sizing paper cellulose pulp referred to in the present embodiment. For instance, sulfite pulp obtained from the broad-leaf tree and needle-leaf tree, chemical pulps such as alkali pulp (AP) and kraft pulp (KP), semi chemical pulp, semi mechanical pulp, mechanical pulp, and waste paper pulp that are deinked secondary fibers can be used. Furthermore, the pulps can be used whether they are bleached or not and whether they are beaten or not. In addition, as cellulose pulp, non-wood pulp such as grass, leaf, bast (phloem), fibers of seeds, as well as pulp such as straw, bamboo, flax, bagasse, kenaf, mitsumata (*Edgeworthia papyrifera*), and cotton linter can also be used. In the present embodiment, it is important that no fillers are contained therein. Furthermore, it is important that water absorptive resins such as polyvinyl alcohol and polyacryl amide are not contained therein. By not containing fillers and water absorptive resins, good reproducibility of the printing dot can be obtained.

As total basis weight of the printing medium, there is no special restriction so far as the basis weight is small and the printing medium is extraordinarily thin. In case the printing is made with printers, range of 40–300 g/m$^2$ is desirable from the standpoint of carrier properties. A more preferable range is 45–200 g/m$^2$, and the opaqueness can be heightened without heightening the paper folding strength. In addition, in case a large number of printing samples are stacked, sticking will not occur so easily.

In the printing medium of the present embodiment, in addition to the above-mentioned cellulose pulp, it is desirable to add sulfate pulp, sulfite pulp, soda pulp, hemicellulase treated pulp, enzyme treated chemical pulp that use fine fibril cellulose, crystallized cellulose, broad-leaf or needle-leaf tree as raw materials. By the addition of these pulps the surface smoothness of the printing medium will be improved and there is effect of improving the feeling. Furthermore, there is also effect of reducing the printing medium surface tack and swell deformation that occur immediately after printing.

In the present embodiment, in addition to the above-mentioned cellulose pulp, mechanical pulps such as bulkiness cellulose fiber, mercerization cellulose, fluffed cellulose, thermo-mechanical pulp may also be added. By adding such pulps, it is possible to improve the ink absorption speed and ink absorption amount of the printing medium.

In the present embodiment, the ink absorption speed of the printing medium can be measured by the well-known dynamic scanning type liquid suction meter. It is preferable for the printing medium of the present embodiment to have an absorption amount of 50 ml/m$^2$ or above in contact time of 25 milli-seconds. If it is within this range, regardless of the ink components, there is effect in preventing the occurrence of beading. Furthermore, it is desirable that the absorption amount be 100 ml/m$^2$ or above in contact time of 100 milli-seconds. If it is in this range, even in case of making multi-printings, occurrence of bleeding, repelling, and beading can be prevented.

The absorption speed and the absorption amount of the liquid can be controlled to the target value by the type and beating degree of the cellulose pulp that are used. In the printing medium of the present embodiment, particularly, the absorption can be improved by the addition of the above-mentioned bulkiness cellulose, mercerization cellulose, fluffed cellulose and mechanical cellulose. In addition, by adding fibril cellulose, crystallized cellulose, sulfate cellulose, sulfite cellulose, soda pulp, hemicellulase treated pulp, and enzyme treated chemical pulp, it is possible to improve the surface properties of the printing medium.

As for the manufacturing method of printing medium for the present embodiment, the manufacturing method for paper used in general can be applied. As paper making machine, it can be selected from among the conventional machines such as Fourdrinier paper machine, cylinder mold paper machine, cylinder, and twin wire, and be used.

In the present embodiment coating of starch performed in the size press process performed for paper making of ordinary paper is not done. In place of this, hydrated alumina and cationic resin are coated on-machine. As the method for on-machine coating, a general coating method can be selected and used. For instance, coating technology based on gate roll coater, size press, bar coater, blade coater, air knife coater, roll coater, brush coater, curtain coater, gravure coater, and spraying machine can be adopted. As for the method of coating, it can be freely selected between the method in which hydrated alumina and cationic resin are mixed and coated, and a method in which each of them is coated separately by on-machine coating.

In the present embodiment, to the printing medium that has undergone on-machine coating, the surface can be made smooth by calender treatment or super-calender treatment as required.

The hydrated alumina that is used in the present embodiment is a boehmite structure hydrated alumina. If it is a boehmite structure that is shown by X-ray diffraction method, hydrated alumina containing metal oxides such as titanium dioxide or silica may also be used. As hydrated alumina having boehmite structure and containing metal oxides such as titanium dioxide, for instance, the ones described in the Japanese Patent No 2714351 can be used. As hydrated alumina having boehmite structure and containing silica, for instance, the ones described in the Japanese Patent Application Laid-open No. 2000-79755 can be used. As a different embodiment, in place of titanium dioxide or silica, oxides of magnesium, calcium, strontium, barium, lead, boron, silicon, germanium, tin, lead, zirconium, indium, phosphor, vanadium, niobium, tantalum, chrome, molybdenum, manganese, iron, cobalt, nickel, and ruthenium can be contained and used.

The form (particle shape, particle size, aspect ratio) of the hydrated alumina can be measured by dispersing hydrated alumina in ion exchange water, and making specimens for measurement by dripping this on to collodion film, and observing this specimen with a transmission electron microscope In the case of quasi-boehmite structure hydrated alumina, as described in the aforementioned document (Rocek J., et al, Applied Catalysis, Vol. 74, Pages 29–36, 1991), the existence of the cilium type and other shapes are generally known. In the present invention, either the cilium type or the flat plate shaped type hydrated alumina may be used.

The aspect ratio of the flat plate shaped particles can be obtained by the method defined in, for instance, the Japanese Patent Application Publication No. 5-16015. The aspect ratio shows the ratio of particle thickness versus the diameter. Diameter in this case shall mean the diameter of a circle that possesses the same area as projected area of the hydrated alumina particle observed through the electron microscope. The vertical and horizontal ratio is observed in the same way as the aspect ratio, and it is the ratio between the diameter indicating the minimum value of the flat plate and the diameter indicating the maximum value of the flat plate. Furthermore, in the case of capillarity bundle type, the method for obtaining aspect ratio is to consider the individual needle shaped particles of the hydrated alumina that forms the capillarity bundle as a cylinder, and after obtaining the top and bottom circle diameters and the length, respectively, obtain the aspect ratio from the ratio between the diameter and the length. The most preferable hydrated alumina shape in the case of flat plate type is one with an average aspect ratio within the range of 3–10, and average particle length in the range of 1–50 nm is desirable. If the average aspect ratio is within the above-mentioned range, in case the ink accepting layer is formed, or in case it is impregnated into the fibrous materials, spaces will form among the particles. Thus, cellular structure having a broad fine pore radius distribution can be easily formed. If the average particle diameter or the average particle length is within the above-mentioned range, in a similar way, a cellular structure having large fine pore volume can be made.

As for the BET specific surface area of the hydrated alumina in the present embodiment, a range within 70–300 m$^2$/g is desirable. In case the BET specific surface area is smaller than the above-mentioned range, the recorded image will become clouded or the water resistance of the image will be insufficient. In case the BET specific surface area is larger than the above-mentioned range, falling of powder easily occurs The BET specific surface area of hydrated alumina, fine pore radius distribution, and fine pore volume can be obtained by the nitrogen adsorption desorption method.

The crystal structure of the hydrated alumina in the printing medium can be measured by the general X-ray diffraction method. The printing medium containing hydrated alumina is attached to the measuring cell, and the peak of the plane (020) appearing at a diffraction angle of $2\theta$=14–15 degrees is measured, and from the diffraction angle 2θ of the peak, and the half value width B, the spacing of the (020) plane is obtained by the Bragg formula, and the crystal thickness perpendicular to the (010) plane is obtained by using the Scherrer formula.

The desirable range for the spacing of the (020) plane of the hydrated alumina in the printing medium is more than 0.617 nm but less than 0.620 nm. In this range, the selection width of the coloring materials such as the dyes used becomes broad, and no matter whether coloring materials that are hydrophobic or hydrophilic are used, the optical density of the printing portion becomes high, and in addition, the occurrence of bleeding, beading, and repelling becomes less. Furthermore, even if printing is made by using coloring materials of hydrophobic and hydrophilic properties together, regardless of the type of coloring materials, the optical density and the dot diameter become uniform. Moreover, even if hydrophilic and hydrophobic materials are contained in the ink, the optical density and the dot diameter of the printing portion remain unchanged, and the occurrence of bleeding, beading, and repelling becomes less. The preferable range for the crystal thickness in the direction perpendicular to the (010) plane is 6.0–10.0 nm. In this range, the ink absorption and adsorption of the coloring material are good, and powder falling becomes less. As to the method for making the plane spacing of the (020) plane of the hydrated alumina in the printing medium and the crystal thickness in the direction perpendicular to the (010) plane come within the ranges specified above, for instance, the methods described in the Japanese Patent Application Laid-open No. 9-99627 can be used.

The degree of crystallinity for the hydrated alumina in the printing medium can be obtained by the X-ray diffraction method in a similar way. Make the printing medium containing hydrated alumina into a powder form and attach this to the measurement cell then measure the intensity when the diffraction angle θ is 10 degrees and the peak of (020) plane that appears when 2θ is 14–15 degrees. The degree of crystallinity can be obtained from the peak intensity of 2θ=10 degrees versus the peak intensity of the (020) plane. The desirable range for the degree of crystallinity for hydrated alumina in the printing medium is 15–80. If it is in this range, the ink absorption becomes good, and in addition, the water resistance of the recorded image becomes good. As for the method of making the degree of crystallinity for the hydrated alumina of the printing medium to come within the above-mentioned range, the method described in, for instance, the Japanese Patent Application Laid-open No. 8-132731 can be used.

The desirable fine pore structures for the hydrated alumina to be used are the following three types, and one or more types can be selected and used as required.

The first fine pore structure is one in which the average fine pore radius of the above-mentioned hydrated alumina is 2.0–20.0 nm, and the half value width of the fine pore radius distribution is 0–15.0 nm. In this case, the average fine pore radius is the one described in Japanese Patent Application Laid-open No. 51-36298 and Japanese Patent Application Laid-open No. 4-202011. Furthermore, half value width of fine pore radius distribution means the width of the fine pore radius that appears at a frequency one half of the average fine pore radius frequency in the measurement results of the fine pore radius distribution.

In the case the average fine pore radius and half value width are within the above-mentioned range, the selection width of the coloring materials that can be used becomes broad, and even if hydrophobic and hydrophilic coloring materials are used, hardly any bleeding, beading, and repelling occurs, and the optical density and dot diameter become uniform. The hydrated alumina that possesses the above mentioned fine pore structure can be made by, for instance, the method described in the Japanese Patent No. 2714352.

The second fine pore structure is one in which a local maximum exists respectively in the fine pore radius distribution of the aforementioned hydrated alumina in a radius range below 10.0 nm and a radius range between 10.0 and 20.0 nm. In the comparatively large fine pores having a radii of 10.0–20.0 nm, the solvent components in the ink are absorbed, and in the comparatively small pores having radii less than 10.0 nm, the coloring material components in the ink are adsorbed. As a result, both the adsorption of coloring material and the absorption of solvent become fast. It is more preferable if the local maximum in the range below radius 10.0 nm is within a range of radius 1.0–6.0 nm. In this range, the adsorption of the coloring material becomes faster. As for the fine pore volume ratio (Volume ratio of local maximum 2) of the local maximum portion in the range of fine pore radius less than 10.0 nm, it is preferable that it be within the range of 1–10% of the whole fine pore volume in order to satisfy both the ink absorption and the deposition of coloring material, and more preferably, within the range of 1–5%. In this range, the absorption speed of the ink and the adsorption speed of the coloring material become fast. The above-mentioned hydrated alumina having fine pore structure can be made by the method described in, for instance, Japanese Patent No 2714350. As methods other than this, a method in which hydrated alumina having its peak at radius 10.0 nm, and hydrated alumina having its peak between radius 10.0 and 20.0 are used together may also be applied.

The third fine pore structure is one in which a maximum peak exists in the range of radius 2.0–20.0 in the fine pore radius distribution of the above-mentioned hydrated alumina. If a peak exists in this range, both the ink absorption and coloring material adsorption are satisfied. In addition, the transparency of the hydrated alumina becomes good, and the clouding of the image can be prevented. A more preferable range of the peak is 6.0–20.0 nm. If the peak exists in this range, bleeding, repelling, and uneven coloring can be prevented even if printings are made by any of the inks among inks using pigments as the coloring material, inks using dye as the coloring material, inks using both dye ink an pigment ink or mixed inks. The most preferable range is 6.0–16.0 nm. In this range, even if inks having three or more different coloring material concentrations are used, a difference in tinting caused by concentration will not occur. The hydrated alumina having the above-mentioned fine pore structure can be made by the method described in, for instance, Japanese Patent Application Laid-open No. 9-66664.

As for the total fine pore volume of the hydrated alumina, the range of 0.4–1.0 $cm^3/g$ is preferable. If it is in this range, the ink absorption is good, and in addition, even if multicolor printing is performed, the tinting is not harmed. Furthermore, to be in the range of 0.4–0.6 $cm^3/g$ means that powder falling and bleeding will not occur easily, and it is preferable. Moreover, if the fine pore volume of the hydrated alumina in the radius range of 2.0–20.0 nm becomes 80% or more of the total fine pore volume, clouding will not occur in the recorded image so it will be all the more preferable. As a different embodiment, it is also possible to agglomerate the hydrated alumina and use it. A range in which the average particle size is 0.5–50 $\mu$/m and the value of BET specific surface area/fine pore volume is 50–500 $m^2/ml$ is preferable. If it is within this range, since a large number of adsorption points of the alumina particles are exposed, the occurrence of beading can be prevented regardless of the record environment (temperature, humidity). The agglomerated particles having the above-mentioned fine pore structure can be used by the method described in the Japanese Patent Application Laid-open No. 8-174993.

Furthermore, in the present embodiment, hydrated alumina treated with coupling agents can be used. As coupling agents to be used, one or more types can be selected among coupling agents of silane type, titanate type, aluminum type, and zirconium type, and applied. If the hydrated alumina becomes hydrophobic by the coupling agents, the color density of the image is high, and since clear images are obtained, it is desirable. If the coupling agent treatment is performed within the range of 1–30% surface area conversion of the whole hydrated alumina, the coloring is heightened without impairing the ink absorption. The above-mentioned coupling agent treatment method can be performed by the method described in, for instance, the Japanese Patent Application Laid-open No. 9-76628.

Furthermore, in the present embodiment, it is possible to use the hydrated alumina by adding substances that can cross-link metal alkoxide and hydroxyl group with it. As metal alkoxide, it can be freely selected from among generally used materials such as, for instance, tetraethoxysilane, and tetramethoxysilane. As material that can cross-link hydroxyl group, there are, for instance, boric acid, or boric acid compounds, and formalin compounds. They can be freely selected from among them. The treatment method can use the method described in, for instance, the Japanese Patent Application Laid-open No. 9-86035. Even in case of printing with ink having high permeability by the addition of large amount of surfactants, the occurrence of bleeding and beading can be prevented.

As cationic resin used in the present embodiment, it can be freely selected from materials among quaternary ammonium salt, polyamine, halogenated quaternary ammonium salt, cationic urethane resin, benzalkonium chloride, benzethonium chloride, and dimethyldiaryl ammonium chloride polymer, and used.

Printing medium used as high speed absorption paper in the present embodiment may contain inorganic salt. In this case, if pigment ink is used as the ink, the coloring becomes good, and it is desirable.

As inorganic salt, in particular, water soluble cerium compounds are preferable. If it is water soluble cerium compound, it may be used with any kind of material.

In the case that printing is performed with water-base ink to the printing medium, if the ink droplet reaches the printing medium, the water soluble cerium compound dissolves and mixes with the ink droplet. Subsequently, the coloring is fixed by acting with pigment coloring material in the ink or the water soluble polymer and emulsion existing in the ink, or the coloring material made into micro-capsules The fixing speed of coloring materials such as water soluble cerium compound is very fast so sufficient fixing can be performed with the recent high speed printing printers or printers having full line head. Therefore, the resolution of fine lines such as characters is high, and there is the advantage that the unevenness of the printing portion mentioned above does not occur so easily. This is an effect that cannot be obtained by the addition of the conventional cationic resin or the addition of other metal salts. In particular, in the case printing is done with printers using full color pigments, this effect is significant. In case comparison is made between character recorded on white background and characters recorded on solid background, in the case of general printing medium, distinct profile of the characters cannot be obtained in the case of solid background, but in the case of the present embodiment even in case of fine lines on solid background, the same clarity as white background can be obtained. Furthermore, even in case of images where the color tone and density change delicately such as the waves of the ocean or flesh tint, high fidelity images can be obtained.

In the case of the present embodiment, among the water soluble cerium compounds, halogenated cerium such as cerium chloride is desirable. Halogenated cerium compounds have high dispersion speed into the ink liquid that has been recorded, and there is the effect that stickiness and coloring hardly occurs when storing the printing medium. An even more desirable water soluble cerium compound is crude rare earth salts. Crude rare earth salts are the residues after removing the target rare earth from the rare earth mineral taken from mineral resources. The main component is cerium chloride. Since the crude rare earth salts are natural product, the oral toxicity is low, and the degree of safety is high. Furthermore, there is the effect that the cost is moderate. In addition, there is effect that the light stability of the image recorded by using dye type ink becomes good.

In the present embodiment, there is no special restriction concerning the addition amount of water soluble cerium compound to the printing medium from the standpoint of image. The desirable addition amount is 0.01 $g/m^2$ or above, preferably 10.0 $g/m^2$ for the composition of the ink accepting layer and composition of base material alone. If it is within this range, high density color development can be obtained at the time printing is performed with water soluble ink. An even more preferable range is 0.1 $g/m^2$ or above, 7.0 $g/m^2$. If it is in this range, it becomes possible to gain uniformity of solid printing portion and prevent the bleeding of fine lines.

As an example for the manufacturing method of the aforementioned high speed absorption paper, in the process for making ordinary printing paper, in place of the process for impregnating sizing agent for papers install a process for impregnating alumina dispersing liquid. In other words, paper is immersed in alumina dispersion liquid, and by controlling temperature of the dispersion liquid and the immersion time, the impregnation amount of alumina is controlled. As shown in FIG. 1, the distribution of alumina particles on both sides of the paper is based on the above-mentioned impregnation process. By this process, in particular, near the surface of the paper the density of the alumina particles become high, but since it does not become a layer structure, even if lots of ink is ejected, it enables the ink to permeate at high speed.

(Embodiment of Ink Ejection Amount)

In the case that printing of the ink jet system is performed by using the above-mentioned high speed absorption paper, it is possible to make the ink landing amount (herein after also referred to as "ejection amount") per one pixel small. Here, "the ejection amount per one pixel" when controlling an ejection amount means the maximum amount ejected for one color of ink. More specifically, in the case of printing a pattern based on data of uniform gradation value, "the ejection amount per one pixel" can be obtained by that the total amount of ink ejected for printing the pattern, density of which is measured as maximum density, is divided by area of the pattern. Accordingly, "the ejection amount per one pixel" may also be expressed as a decimal such as 1.5 droplets, in a printing apparatus which is structured to be able to eject two ink (or processing liquid) droplets each having 8 pl in volume to one pixel at the maximum.

Figure 9:
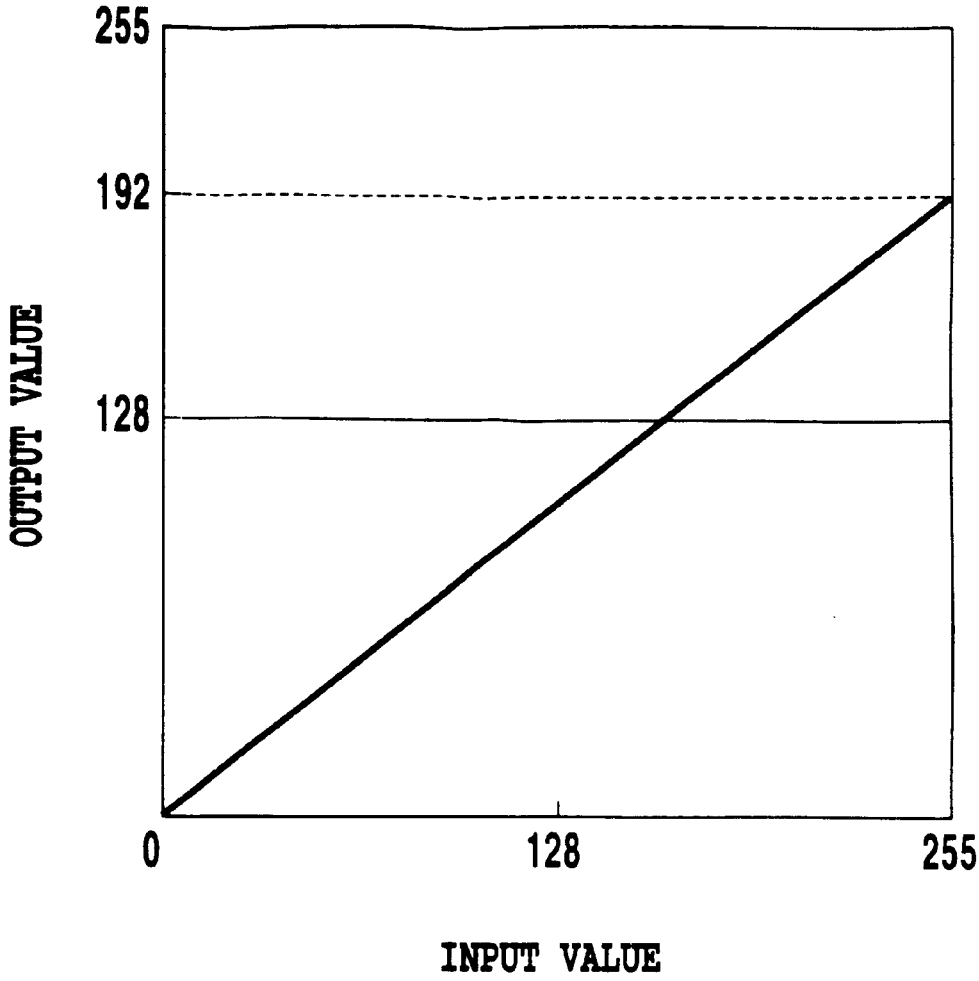
FIG. 9 is a graph showing a relation between an input value and an output value in a gamma table.

One example of controlling the ink ejection amount in the printing apparatus will be described with reference to FIG. 9. FIG. 9 is a diagram showing a content of a gamma table for gamma correction.

In the case of the printing apparatus which is structured such that two ink droplets can land on one pixel as a maximum amount when using the gamma table which transforms input value of 255 in a form of 8 bit data into output value of 255, control of the ink election amount uses the gamma table which transforms input value of 255 into output value of 192, as shown in FIG. 9, and then causes the output value to be quantized by use of error diffusion method or the like to be made form of printing data. In printing with the thus obtained printing data, the ink ejection amount per one pixel (mean ejection amount) defined as described above in the printed pattern, which is printed based on data of maximum input value 255 inputting to the gamma table, becomes 1.5 droplets. Furthermore, besides the above, for instance, instead of ejecting 2 droplets per one pixel, only one droplet may be ejected. By doing so, there will be no missing image data, and higher definition image can be obtained.

According to the study made by the inventors of the present invention, in the case of using high speed absorption paper, the ink ejection amount for one pixel of 600 dpi is in a range of 5 pl–15 pl so as to obtain sufficient dot diameter and density. In other words, with the ink ejection amount of about $2.8\times10^{-3}$ pl/$\mu$m$^2$—about $8.4\times10^{-3}$ pl/$\mu$m$^2$ for unit area of the printing paper, sufficient image density can be obtained. Contrary to this, in case that the ink ejection amount is excessive, the ink will easily appear as bleeding around the dot and sometimes the sharpness of an edge that is a profile portion of a printed image will be degraded. In particular, in the case of color dye ink, the proper ink ejection amount thereof is 4 pl–10 pl per one pixel for the high speed absorption paper. In other words, the ink ejection amount corresponds to the amount per unit area of the printing paper at a range of $2.2\times10^{-3}$ pl/$\mu$m$^2$–$5.6\times10^{-3}$ pl/$\mu$m$^2$.

For instance, a dot diameter, when printing is performed at the amount of 8 pl per one pixel, is about 60 $\mu$m in the case of black (Bk) ink containing a pigment and about 80 $\mu$m in the case of color dye ink. In this case, the spreading rate is about 2.3 in the case of Bk pigment ink and is about 3.1 in the case of color dye ink. In this way, the high speed absorption paper can achieve a large spreading rate without depending on the type of ink. Thereby, the relatively small ink ejection amount, which is combined with the fact that the coloring materials are retained in a shallow portion of the surface layer, enables printing with a high density image.

Here, the spreading rate corresponding to a rate which shows to what degree the dot diameter on the printing medium expands when compared with the diameter of the ink droplet, which is obtained by assuming the droplet to be a sphere and converting the volume of the sphere into the diameter.

In the case that pigment ink is used, in comparison with the ink solvent, the pigment can not diffuse easily on the surface of the printing paper. Thus, in comparison with dye ink, the dot diameter does not become so large. However, as mentioned above, at the surface of the printing paper, the alumina reacts with the pigment, and by coagulation and adsorption, it makes possible the improvement in density and edge sharpness. In addition, adding cationic polymer and inorganic salts to the high speed absorption paper is preferable from the point that the density is further improved. Even in the case of dye ink, since the dye is adsorbed by the alumina particles, in particular, it is possible to make the density of the solid printing portion high. Although the density value varies somewhat with the type of ink and the concentration of the dye, in any case, the density becomes higher.

It is desirable to adjust the spreading rate of the high absorption paper of the present embodiment to 2.5 or above in the case of the dye ink and to 2.0 or above in the case of the pigment ink.

Contrary to this, an ordinary paper such as a copy paper which are normally used, the spreading rate is not so large, and for the dye ink of so-called overlay type having low permeability, the spreading rate is about 2, and for the ink having high permeability, the spreading rate is about 2.6.

Embodiments of Dot Formation

FIGS. 3A–3D are diagrams for explaining the feature of the high speed absorption paper in comparison with the ordinary paper, on points where the coloring materials are retained at the relatively shallow portion, a rather large dot can be formed by permeation of ink along the surface layer, and fast permeation of the ink solvent in the thickness direction of the printing medium. These figures show the ink dot formation process in the case that different types of inks are ejected on to the high speed absorption paper and the ordinary paper, respectively.

As shown in FIGS. 3A–3D, in relation to the high speed absorption paper and ordinary paper, when the ink droplet ejected from the printing head lands on the respective printing medium (time of landing; $t_0$), a cylindrical ink droplet having a diameter that is about twice as large in comparison with the diameter of the discharged ink droplet, is formed.

Figures 3A, 3B, 3C, 3D:
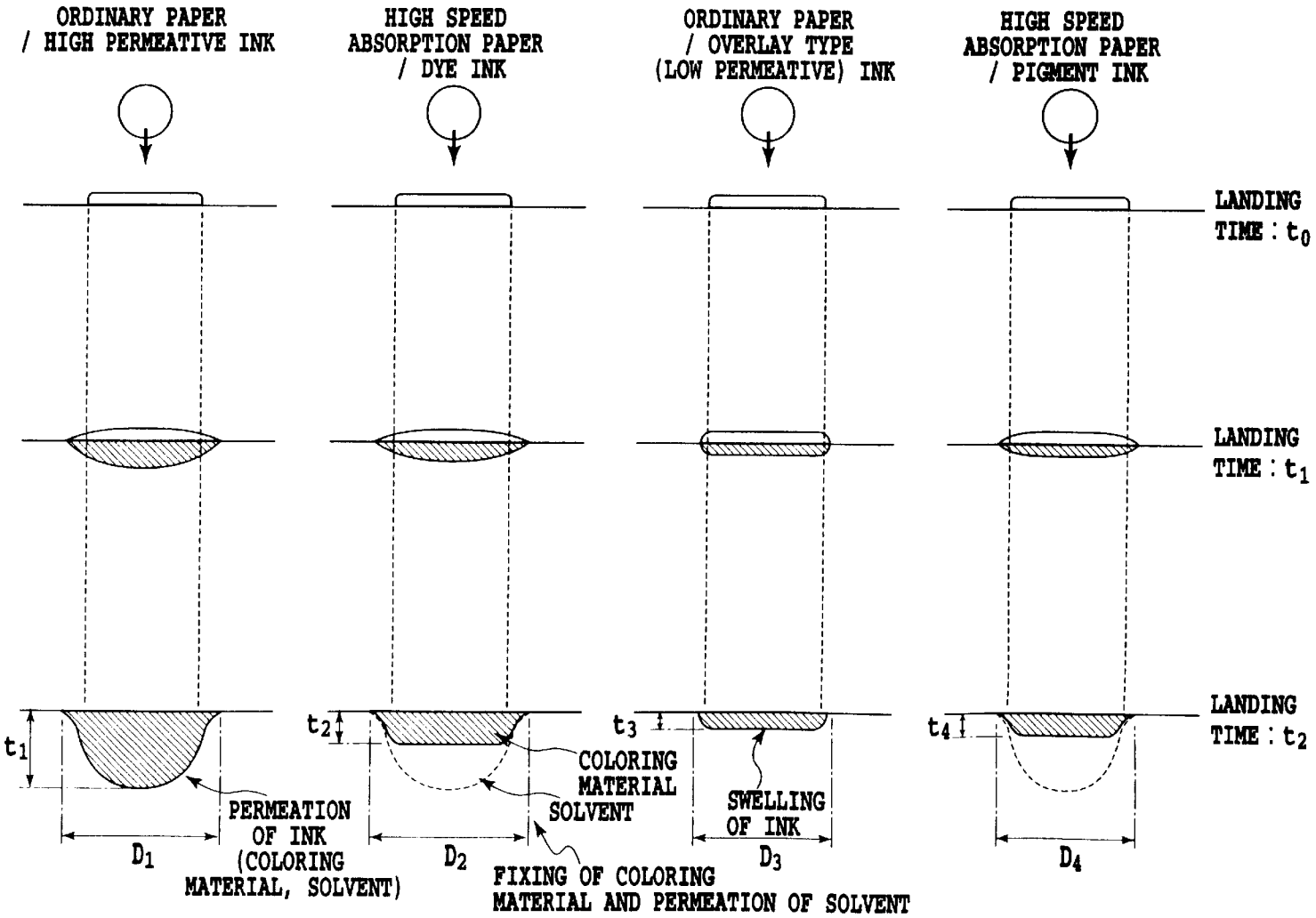
FIGS. 3A–3D are diagrams explaining the difference in ink dot formation between an ordinary paper and a high speed absorption paper in relation to the embodiment.

In the case of the high speed absorption paper, as mentioned before, basically sizing agents are not contained therein, or even if they are contained therein, only in traces. Therefore, when the specified time ($t_1$) elapses, as shown in FIGS. 3B and 3D, the ink permeates rather rapidly in all directions of the paper. This mechanism is the same even for the ink of the so-called overlay type. Even on the surface of this paper, the high speed absorption paper combined with the fact that the wettability of the ink against the paper is high, can make the ink also permeate rapidly in the transverse direction along the paper surface layer to make the dot diameter large. Contrary to this, in the case of the ordinary paper, as shown in FIG. 3C, the spreading in the transverse direction is small and the dot diameter does not become so large in the case of the overlay type ink.

As the time further elapses (t2), the permeation of ink progresses. In this progression process, since the high speed absorption paper contains alumina particles in its surface layer portion, the coloring materials in the ink are adsorbed by the alumina particles to be fixed to the very shallow regions of the paper, as shown in FIGS. 3B and 3D. At the same time, the water solvent in the ink separates from the coloring materials such as dyes or the like to permeate in the paper through the spaces among the fibers. On the other hand, for the case of the ordinary paper, as shown in FIG. 3A which shows the permeation of ink in the ordinary paper combined with the high permeative ink, the coloring materials in the ink permeates in the depth direction of the printing paper together with the solvent in the ink. As a result, the amount of coloring materials that remain in the surface layer portion of the paper becomes small.

In the above-mentioned dot formation mechanism, the relation among the dot diameters that are finally obtained are: $D_1$ shown in FIG. 3A and $D_2$ shown in FIG. 3B are approximately equal, $D_1$ is larger than $D_3$ shown in FIG. 3C, and further, $D_2$ is larger than $D_4$ shown in FIG. 3D.

As mentioned previously, when cationic polymer or inorganic salts are contained in the high speed absorption paper, in particular, in case pigment inks are used, the above degree becomes all the more significant, and this is desirable since the density and the edge sharpness are improved.

(Embodiment 1 of Apparatus Configuration)

A printing heads as an ejection portion, ejects black (in the specification also referred to as simply Bk), cyan (in the specification also referred to as simply C), magenta (in the specification also referred to as simply M), and yellow (in the specification also referred to as simply Y) inks and processing liquid (in the specification also referred to as simply S), respectively.

In the case of printing on the ordinary paper, at least a black image is formed by mixing and reacting the Bk ink and the processing liquid on the printing medium. More specifically, there is the case in which the Bk ink is ejected to the printing medium followed by the processing liquid, and the case in which the processing liquid is first ejected to the printing medium followed by the Bk ink. Thereby, the black image has high density to be high grade one. Moreover, it is preferable that pigment is used for the Bk ink to cause a print density to be high.

In regards to the color ink, it is used by reaction with the processing liquid or is used alone. It is desirable to use high permeative processing liquid and color ink to cause both the black image and the color image to be fixed rapidly and then enable high speed printing.

In the case of performing printing on the high speed absorption paper, as mentioned above, the ink ejection amount per one pixel of each of the ink and the processing liquid is made less than those for the printing mode of the ordinary paper. For instance, in relation to pixel of 600 DPI, 2 droplets of Bk ink are ejected for an ordinary paper mode, whereas 1 droplet is ejected for a high speed absorption paper mode.

Similarly, the processing liquid is ejected 1 droplet for the ordinary paper mode, and ejected 0.5 droplet for the high speed absorption paper mode.

In this way, in the case of the high speed absorption paper mode, in spite of the number of ink and processing liquid droplets being decreased in comparison with the ordinary paper printing mode, the dot size on the high speed absorption paper is larger when compared with that of ordinary paper and the density becomes high to obtain the high quality image.

As mentioned above, since the image is formed with less number of droplets, it becomes possible to set the drive frequency of the printing head higher, or make a scanning speed or a paper feeding speed faster. Thus, the printing apparatus enables high speed printing.

In other aspect, since the printing paper that has undergone rapid printing by the printing apparatus rapidly absorbs and fixes the ink on the printing paper, there is no fear of the ink being transferred to other materials when the paper is discharged. Thus, it is possible to perform substantial high speed printing.

In addition, the ink ejection amount is made less in comparison with the ordinary paper and result in, together with the fact that the coloring material is easily trapped on the surface of the high speed absorption paper, that the density on the backside of the printed surface of the paper will become small. That is, the so-called "strike through" does not occur easily. Furthermore, the small ink ejection amount causes cockling that accompanies the swelling of paper caused by the ink to be slight, and the high permeative ink causes double side printing to be performed easily.

In this case, since the ink ejected on the high speed absorption paper is adsorbed by the alumina particles, the water resistance will also be high. The reasons that the Bk ink and the processing liquid are made to react positively when forming the black image are the following two:

The first reason is that cases wherein the high speed absorption paper becomes out of stock, or the user sets the ordinary paper by mistake instead of the high speed absorption paper, or intentionally, to the paper feeding cassette, can be considered. Even in such a case, by the reaction of the processing liquid and the ink, a high quality image with high quality can be obtained. In addition, by making the processing liquid a high permeative one, the ink image can be fixed at high speed and then substantially high speed printing becomes possible.

In particular, when the so-called overlay type ink containing pigment is used as Bk ink, the print quality of the black characters can be improved. In this case, the Bk ink is used for ordinary paper so that Bk ink reacts with the processing liquid to cause the fixation to be more desirable. In addition, it is also quite preferable from the standpoint of preventing the bleeding of Bk ink and the color ink.

Furthermore, even in the case that the color ink is used independently without the processing liquid with high permeability, if the permeability of the ink is high, the print image can be fixed at high speed, and substantial high speed printing becomes possible.

The second reason is that when, for instance, the black dot is formed by mixing the Bk ink and the processing liquid on the high speed absorption paper, an even higher density print image can be obtained. This is especially significant in the case of using the ink contains pigments.

(Embodiment 2 of Apparatus Configuration)

Another embodiment of the apparatus configuration is that has two or more modes for the high speed absorption paper or high speed printing, of the above-mentioned embodiment. More specifically, the configuration also has the printing mode for the high speed absorption paper, in which the processing liquid is not ejected.

One method of executing the two or more printing modes is that a user confirms that the printing medium set is the high speed absorption paper through the printer driver or the like and after this confirmation the user changes the printing mode to the printing mode that does not use the processing liquid. For instance, on the printer driver, when the high speed printing mode is normally selected, the dot formation is executed by mixing the ink and the processing liquid. However, when further selecting the high speed absorption paper as the printing medium, on the printer driver, it can be processed so that the printing mode is caused to be the mode without the mixture of the ink and the processing liquid.

Furthermore, another method is that, when merely the high speed printing mode is set, the printing apparatus side determines as to whether set paper is the ordinary paper or the high speed absorption paper, and when it determines that the high speed absorption paper is set, executes the mode so that the processing liquid is not used. According to this method, the user need not worry about the type of paper that is set, and the mode can be executed correspondingly to set printing paper type based on as to whether the printing mode is the high speed printing or not.

(Embodiment 3 of Apparatus Configuration)

The printing apparatus of the present embodiment has four printing heads as ejection portions, which ejects Bk, C, M and Y inks, respectively. When printing are performed for the ordinary paper, the black image includes a part which is formed by that the Bk ink and the color ink are mixed and reacted on the printing medium. Concretely speaking, there are cases in which the Bk ink is ejected to the printing medium, then the color ink is ejected, and the case in which the color ink is ejected first, then the Bk ink is ejected next. These printing method are desirable in the case of the black image having relatively high printing duty and a large image area because fixation of the ink can be improved. Furthermore, it is preferable that the printing data of the color ink is thinned out in relation to the Bk ink. Thereby, the black image has high density to be of high print quality. More specifically, it is preferable that pigment are used for Bk ink to improve the print density in this case. Furthermore, it is desirable that polyvalent metal salts is contained in the color ink so that the Bk pigment ink and the polyvalent metal ions react, thereby the pigment particles are coagulated to remain easily on the surface of the paper and the print density becomes high.

In this case, preferably the Bk ink is used as one having low permeability of the so-called overlay type ink in order to improve the printed character quality (in particular, the print density and the sharpness of an image profile) On the other hand, the overlay type ink for the ordinary paper has small spreading rate so that the dot diameter does not become large, and therefore preferably the ink ejection amount per one pixel of overlay type ink is set at twice that of the permeative color ink. For example, the amount of the overlay type ink is set so that the ejection volume of one ink droplet (ejection amount) is twice as much.

In the above manner, the color ink is used as the ink of high permeability, and then the fixing properties of the black print image and the color print image can be made fast so that high speed printing preferably can be executed.

On the other hand, in case of performing printing on the high speed absorption paper, for each ink, the ink ejection amount per one pixel is made smaller than that for the printing mode for the ordinary paper. For instance, to one pixel of 600 DPI, the Bk ink is ejected 2 droplets for the ordinary paper mode, 1 droplet for the high speed absorption paper mode.

Supposing that 2 droplets are ejected to the high speed absorption paper in the same way as the ordinary paper mode, the dot diameter becomes too large and there is possibility of the characters being deformed. This dot formation is not desirable.

Furthermore, similar to the printing for the ordinary paper, the color ink may be preferably mixed to Bk ink to print the improved print density of the black image.

In this way, printing on the high speed absorption paper makes the number of printing dots less in comparison with that in printing for ordinary paper. In spite of this, the dots become larger than that of the ordinary paper and the print density is high, so that image with high picture quality can be obtained.

For the permeative color ink, though the dot diameter thereof does not become larger significantly for the high speed absorption paper in comparison with that for the ordinary paper, even the coloring material is retained near the surface and does not permeate deeply, so that the print density can be increased.

In addition, since the spreading rate of the permeative ink is large, the ink ejection amount for the ordinary paper is sufficient for satisfying the so-called area factor. On the other hand, since the coloring material permeate also in the thickness direction, the high print density is not achieved. Thus, the ink ejection amount is caused to be increased to assure the print density for the ordinary paper. Therefore, even if the ink ejection amount for the high speed absorption paper is one-half of that for the ordinary paper, an image can be formed with sufficient print density.

As mentioned above, since the image with less number of ink dots are formed, it is possible to set the driving frequency of the printing head at a higher point, so that the printing apparatus can perform high speed printing.

In other aspect, since the printing paper that has undergone rapid printing by the printing apparatus rapidly absorbs and fixes the ink on the printing paper, there is no fear of the ink being transferred to other materials when the paper is discharged. Thus, it is possible to perform substantial high speed printing.

In addition, the ink ejection amount is made less in comparison with the ordinary paper and result in, together with the fact that the coloring material is easily trapped on the surface of the high speed absorption paper, that the density on the backside of the printed surface of the paper will become small. That is, the so-called "strike through" does not occur easily. Furthermore, the small ink ejection amount causes cockling that accompanies the swelling of paper caused by the ink to be slight, and the high permeative ink causes double side printing to be performed easily.

(Embodiment 4 of Apparatus Configuration)

The apparatus configuration of the present embodiment has four printing heads as the ejection portion and eject Bk, C, M and Y inks, respectively.

In the case of performing printing on the ordinary paper, a black image is formed with the Bk ink alone. Thereby, the black image has high print density to be of high quality. More specifically, preferably pigment is used for the Bk ink, and then the print density becomes high.

For a color ink, high permeative one is preferably used to make fixing ability of a color image fast. Then high speed printing can be achieved.

On the other hand, for the case of printing on the high speed absorption paper, the ink ejection amount per one pixel for each ink is made less in comparison with the printing mode for the ordinary paper. For instance, in relation to one pixel of 600 DPI, while 2 droplets of the Bk ink are ejected for the ordinary paper mode, 1 droplet is ejected for the high speed absorption paper mode.

In this way, printing on the high speed absorption paper makes the number of printing dots less in comparison with that in printing for ordinary paper. In spite of this, the dots become larger than that of the ordinary paper and the print density is high, so that image with extremely high picture quality can be obtained.

As mentioned above, since the image with less number of ink dots are formed, it is possible to set the driving frequency of the printing head at a higher point, so that the printing apparatus can perform high speed printing.

In other aspect, since the printing paper that has undergone rapid printing by the printing apparatus rapidly absorbs and fixes the ink on the printing paper, there is no fear of the ink being transferred to other materials when the paper is discharged. Thus, it is possible to perform substantial high speed printing.

(Embodiments of Printing Mode)

Here, a description is given on the examples of printing modes particularly in embodiments 1 and 2 of the above-mentioned apparatus configurations.

TABLE 1

| | High speed printing mode 1 | Normal printing mode | High speed printing mode 2 |
|---|---|---|---|
| Bk ink | 1.5 droplets | 2.5 droplets | 1.5 droplets |
| Processing liquid | 0.5 droplets | 1 droplet | 0 droplet |
| Color ink | 1 droplet | 2 droplets | 1 droplet |

Table 1 shows the ejection amount of the ink or the processing liquid at each printing mode to be explained below.

Normal Printing Mode: Ordinary Paper and High Quality Printing Mode

In the present printing mode, 2.5 droplets of Bk ink are ejected to one pixel of 600 DPI as droplets of about 8 pl. Thereby, about the volume of 20 pl is ejected into one pixel. This amount of ejection can be realized in a manner that, as mentioned before, a gamma table of a suitable maximum output density is set and then execute a gamma correction for the printing data. In the above case, since 1 droplet or more ejected to one pixel, either plurality times of ejection is executed for one pixel from the same printing head, or by preparing plurality of printing heads for the same ink. Thereby, it is possible to eject a plurality of droplet to one pixel. After ejecting the above-mentioned Bk ink, one droplet of the processing liquid of about 8 pl is ejected to the pixel so that the droplets are overlaid on the Bk ink.

Furthermore, for the color ink, 2 droplets each having the volume of about 8 pl are ejected to one pixel of 600 DPI. In this case, the color ink and the processing liquid are not made reacted on the paper, but they may be made reacted.

The reason that the number of droplets shown in the above example includes non-natural numbers is that the ejection amount is processed as printing data as described before, and needless to say, the numbers represent the average amount.

Printing performed as the above-mentioned way can give high print density for the black image. Moreover, the ink, as mentioned later on, contains pigment and a high permeative processing liquid is used, so that high print quality and high speed fixation are both realized.

In the case of printing color images, images of high print density can be obtained to realize high quality images. In relation to the color ink, the processing liquid may be ejected before the ejection of the color ink, and the color ink having high permeation may be used without any processing liquid.

High Speed Printing Mode 1: High Speed Absorption Paper Mode

The present printing mode is has the ink ejection amount in which 1.5 droplets of Bk ink is ejected into one pixel of 600 DPI as a droplet of about 8 pl to apply about 12 pl of ink to one pixel. Subsequently, to the same pixel, about 8 pl of processing liquid is ejected so that 0.5 droplets overlap on the Bk ink.

Furthermore, the color ink is ejected to one pixel of 600 DPI at 1 droplet of about 8 pl.

The relative speed between the printing head and the printing paper is set to be twice that of the above-mentioned normal printing mode. Thereby, high speed printing can be executed while the driving frequency of the printing head itself does not change, and a refill frequency of the printing head need not to be increased.

Performing printing in the above-mentioned manner can cause the black image to have high print density and to have a sharp profile edge on the high speed absorption paper. Furthermore, printing images including color images can be printed with high speed.

As is clear from the above-description, according to the present printing mode where the relative movement speed between the printing head and the printing paper is increased and high speed absorption paper is used, the ink spreads on the surface of the printing paper and the dot diameter becomes larger. Though accompanying the permeation of the ink, the dot diameter growing larger, the coloring material near the surface is trapped by the alumina particles and thereby they do not sink easily in the depth direction so that the image density is high. In addition, since the ejection amount per one pixel can be made small, high speed, high print quality and low running cost are achieved as a result. Further, cockling occurs less and double sided printing is also sufficiently possible.

In particular, in the case of printing the black image, the processing liquid is used and is made reacted with Bk ink, so that the dot can be prevent form spreading more than necessary, and the shape of print image is not deformed and good edge sharpness can be obtained.

Furthermore, even when printing is performed on the ordinary paper in this printing mode, since the amount of ink ejected per unit area of the paper is small and the permeative processing liquid is used, ink can be fixed to the paper fast and problems such as set-off can be reduced.

High Speed Printing Mode 2: High Speed Absorption Paper Mode 2

In the present printing mode, 1.5 droplets of Bk ink, having volume of about 8 pl per droplet, are ejected to one pixel of 600 DPI to apply about 12 pl of ink per one pixel. In the present mode, to the portion where the Bk ink is applied, no processing liquid is applied. Furthermore, for the color ink, one droplet of about 8 pl is ejected to one pixel of 600 DPI.

Even in case where no processing liquid is used as in this case, the print quality can be prevented from being degraded and printing with low running cost can be made on the high speed absorption paper.

Embodiments of Ink

Next, an explanation is given on the ink used for ink jet printing related to one of the embodiments of the present invention. Ink of the present embodiment is ink that contains the No. 1 pigment and the No. 2 pigment. This ink is used for forming image dots by making the processing liquid come into contact and react with the ink in the liquid state after the ink has been ejected to the printing medium or ejecting the ink on to the printing medium at substantially the same time as the processing liquid that reacts with the ink.

As an example of the ink that can be used for the above-mentioned embodiment, for instance, an ink containing a first pigment and a second pigment as coloring material in water base solvent in a dispersed state, and the first pigment is a self-dispersion type pigment that has at least one anionic group bound to the surface of the first pigment either directly or via other atomic groups, or a self-dispersion type pigment that has at least one cationic group bound to the surface of the first pigment either directly or via other atomic group, and the second pigment is a pigment that can be dispersed in the water base solvent by polymer dispersing agents or nonionic polymer dispersing agents, and the ink further contains at least one of the polymer dispersing agent having the same polarity as the group bound to the surface of the first pigment and a nonionic polymer dispersing agent, can be given.

An explanation of the ink is given below in order.

First Pigment

The self dispersing type pigment means a pigment that maintains a stable dispersion state against water, water soluble organic solvent, or a liquid which is a mixture of them without using dispersing agents such as water soluble polymer compounds, and that forms no agglomeration of the pigments in the liquid which may hinder the normal ink discharge from the opening used in the ink jet printing technology.

Anionic Self-Dispersing Type Carbon Black

As such a pigment, for instance, a pigment that has at least one anionic group bound to the surface of the pigment either directly or via other atomic groups is favorably used, and as a concrete example, at least one anionic group bound to the surface of carbon black either directly or via other atomic groups is included.

Examples of anionic groups bound to such carbon black inclued, for instance, —COOM, —$SO_3M$, —$PO_3HM$, —$PO_3M_2$, etc. (M in the formula represents hydrogen atom, alkali metal, ammonium, or organic ammonium, R stands for alkyl groups of either linear or branched chains having a carbon number ranging from 1 to 12, phenyl group and its substitutional group, or naphthyl group and its substitutional group). In case R is a phenyl group possessing a substitutional group, or a naphthyl group possessing a substitutional group, for the substitutional group, for instance, alkyl groups of the linear chain or branched chain having a carbon number from 1 to 6 can be used.

As alkali metal of the above mentioned "M", for instance, lithium, sodium, potassium, can be given. Furthermore, as organic ammonium of "M", mono- or tri-methyl ammonium, mono- or tri- ethyl ammonium, mono- or tri-methanol ammonium can be given.

Among these anionic groups, in particular, —COOM and —$SO_3M$ have large effect in stabilizing the dispersion state of carbon black, and this is desirable.

As for the above-mentioned various anionic groups, it is preferable to use those that are bound to the surface of the carbon black via other atomic groups. As other atomic groups, for instance, linear chain or unsubstituted alkylene groups having carbon number from 1 to 12, phenylene group or its substitutional group, naphthylene group or its substitutional group can be given. In this case as examples of substitutional groups that can be bound to phenylene group or naphthylene group, alkyl groups of the linear chain or branched chain having a carbon number from 1 to 6 can be given.

As concrete examples of anionic group bound to the surface of carbon black via other atomic group, for instance, —$C_2H_4$COOM, —Ph$SO_3M$, —PhCOOM, etc. (where Ph stands for a phenyl group) can be given, but of course, it is not restricted to these examples.

As mentioned above, the carbon black that has anionic group bound to its surface directly or via other atomic group can be manufactured by, for instance, the following method.

As a method to introduce —COONa to the surface of the carbon black, for instance, a method in which carbon black sold on the market undergoes oxidation treatment with sodium hypochlorite can be given.

Furthermore, for instance, as a method to bind —Ar—COONa group (In this case Ar stands for aryl group) to the surface of the carbon black, diazonium salt made by reacting nitrous acid with $NH_2$—Ar—COONa group, and binding this to the surface of the carbon black, can be given.

The above mentioned various types of hydrophilic groups may be bound to the surface of the carbon black directly, or let other atomic group come between the carbon black surface and the hydrophilic groups, and bind the hydrophilic groups to the carbon black surface indirectly. In this case, concrete examples of other atomic groups are, for instance, alkylene group of linear chain or branched chain having number of carbon atoms in the range of 1–12, phenylene group or its substitutional group, naphthylene group or its substitutional group, can be given. In this case, as substitutional groups of phenylene group and naphthylene group, for instance, alkyl group of linear chain or branched chain having number of carbon atoms in the range of 1–6, can be given.

Furthermore, as a concrete example of the combination of other atomic group and hydrophilic group, for instance, —$C_2H_4$—COOM, —Ph—$SO_3M$, —Ph—COOM, etc. (where Ph represents a phenyl group) can be given.

It is preferable that 80% or more of the particle sizes of the self-dispersion type pigments contained in the ink related to the present embodiment are in the range of 0.05–0.3 $\mu$m, in particular, 0.1–0.25 $\mu$m. Adjustment method of such an ink is as described in details in the embodiments that follow.

Second Pigment

As the second pigment that can be used for the ink of the present embodiment, pigments that can be dispersed by the dispersion medium of the ink, concretely speaking, for instance, pigments that can be dispersed by the action of polymer dispersing agent for the water based medium, can be given. In other words, pigments that can obtain stable dispersion against water based medium for the first time as a result of polymer dispersing agent being adsorbed on the surface of the pigment particles, can be favorably applied. As such pigments, for instance, as black pigment, carbon black pigments, for instance, furnace black, lamp black, acetylene black, and channel black can be given. As concrete examples of such carbon black, for instance, the following are used alone, or suitably combined and used.

Carbon Black Pigment:

Raven 7000, Raven 5750, Raven 5250, Raven 5000 ULTRA, Raven 3500, Raven 2000, Raven 1500, Raven 1250, Raven 1200, Raven 1190 ULTRA-II, Raven 1170. Raven 1255 (The above products are manufactured by Columbian Chemicals Div., Cities Service Co.)

Black Pearls L, Regal 400R, Regal 330R, Regal 660R, Mogul L, Monarch 700, Monarch 800, Monarch 880, Monarch 900, Monarch 1000, Monarch 1100, Monarch 1300, Monarch 1400, Vulcan XC-72R (The above products are manufactured by Cabot Corp.)

Color Black FW1, Color Black FW2, Color Black FW2V, Color Black 18, Color Black FW200, Color Black S150, Color Black S160, Color Black S170, Printex 35, Printex U, Printex V, Printex 140U, Special Black 6, Special Black 5, Special Black 4A, Special Black 4 (The above products are manufactured by Degussa Corp.)

No. 25, No. 33, No. 40, No. 47, No., 52, No. 900, No. 2300, MCF-88, MA600, MA7, MA8, MA100 (The above products are manufactured by Mitsubishi Chemical Corp.)

As for other black pigments, fine particles of magnetic substances such as magnetite and ferrite, and titanium black can be given.

Besides the black pigments given above, blue pigments and red pigments may also be used.

The amount of coloring materials combining the above-mentioned first and second pigments shall be 0.1–15 weight % against the total amount of ink, and more preferably, 1–10 weight %. The ratio between the First pigment and Second pigment=5/95–97/3, and more preferably 10/90–95/5. Even more desirable is first pigment/second pigment=9/1–4/6.

Further desirable range is a range in which the first pigment is large. In a case where the first pigment is large, high stability is exhibited not only in dispersion stability as an ink, but also ejection stability of the head, in particular, stability including reliability based on discharge efficiency and less wetting at the discharge outlet plane.

Furthermore, as behavior of the ink on paper, since ink will spread on the surface of paper effectively in case of inks having less second pigments adsorbed by the polymer dispersing agents, it is estimated that a uniform film based on polymer dispersing agent is formed on the surface, and by this effect, abrasion resistance of the image is also improved.

As for the high molecular dispersing agent for dispersing the above-mentioned second pigment in water based medium, for instance, a dispersing agent that possesses the function of adsorbing to the surface of the second pigment, and stably dispersing the second pigment in the water based medium can be suitably used. As examples of such high molecular dispersing agent, anionic high molecular dispersing agent and 3 nonionic high molecular dispersing agent can be given.

Anionic High Molecular Dispersing Agent

Polymers and their salts consisting of monomer as hydrophilic group and monomer as hydrophobic group, can be given. As concrete examples of monomers as hydrophilic group, for instance, styrene sulfonic acid, α, β ethylenic derivatives, acrylic acid, acrylic acid derivatives, methacrylic acid, methacrylic acid derivatives, maleic acid, maleic acid derivatives, itaconic acid, itaconic acid derivatives, fumaric acid, fumaric acid derivatives, etc., can be given.

Furthermore, concerning concrete examples of monomer as hydrophobic components, for instance, styrene, styrene derivatives, vinyl toluene, vinyl toluene derivatives, vinyl naphthalene, vinyl naphthalene derivatives, butadiene, butadiene derivatives, isoprene, isoprene derivatives, ethylene, ethylene derivatives, propylene, propylene derivatives, alkyl ester of acrylic acid, alkyl ester of methacrylic acid, etc., can be given.

In this case, as concrete examples of salts, the so-called "-onium" compounds of hydrogen, alkali metals, ammonium ions, organic ammonium ions, phosphonium, sulfonium, oxonium ion, stibonium, stannonium, iodonium, etc., are given, but they shall not be limited to these examples. To the above polymers and salts, polyoxy ethylene group, hydroxyl group, acrylamide, acrylamide derivatives, dimethylaminoethyl methacrylate, ethoxytriethylene methacrylate, methoxypolyethylene glycol methacrylate, vinyl pyrolidone, vinyl pyridine, vinyl alcohol, and alkyl ether may be added suitably.

Nonionic High Molecular Dispersing Agent

As examples of nonionic high molecular dispersing agent, polyvinyl pyrolidone, polypropylene glycol, vinyl pyrolidone vinylacetate copolymer are included.

By suitably selecting the combination of the first pigment, the second pigment, and the high molecular dispersing agent mentioned above, and dispersing and dissolving them in water based medium, the ink mentioned in the present embodiment can be made, but as First pigment, in case a self dispersion type pigment that has at least one anionic group bound to its surface directly or via other atomic group is used, as high molecular dispersing agent, to combine at least one dispersing agent selected from anionic high molecular dispersing agent and nonionic high molecular dispersing agent is desirable from the standpoint of ink stability.

As for the weight ratio between the second pigment and the high molecular dispersing agent that disperses the pigment in the ink is 5:0.5–5.2 is desirable.

Water Based Medium

As water based medium that becomes the dispersing medium for the first pigment and the second pigment, water soluble organic solvents are used. As water soluble organic solvents, for instance, alkyl alcohols having carbon number of 1–5 such as methyl alcohol, ethyl alcohol, n-propyl alcohol, isopropyl alcohol, n-butyl alcohol, sec-butyl alcohol, tert-butyl alcohol, isobutyl alcohol, and n-pentanol; amides such as dimethyl formamide, dimethyl acetoamide, etc.; ketones or ketoalcohols such as acetone, diacetone alcohol, etc., ethers such as tetrahydrofuran, dioxane, etc.; oxyethylene or oxypropylene copolymers such as diethylene glycol, triethylene glycol, tetraethylene glycol, dipropylene glycol, tripropylene glycol, polyethylene glycol, polypropylene glycol, etc.; alkylene glycols including alkylene groups having 2–6 carbon atoms such as ethylene glycol, propylene glycol, trimethylene glycol, triethyleneglycol, 1,2,6-hexanetriol, etc.; lower alkyl ethers such as glycerine, ethylene glycol monomethyl (or ethyl) ether; diethylene glycol monomethyl (or ethyl) ether; lower dialkylethers of polyhydric alcohol such as triethylene glycol dimethyl (or ethyl) ether, tetraethylene glycol dimethyl (or ethyl) ether, etc.; alkanolamines such as monethanol amine, diethanol amine, triethanol amine, etc.; as well as sulfolane, N-methyl-2-pyrolidone, 2-pyrolidone, 1,3-dimethyl-2-imidazolidinone, etc., can be given. These water soluble organic solvents can be used alone or as mixtures.

Permeation property of the Ink to Printing Medium

As for the ink of the present embodiment that contains the various components described above, attention was paid to the permeability against the printing medium, for instance, in case the Ka value is adjusted to less than 1 (ml $m^{-2}$ $msec^{-1/2}$), owing to the joint use of the processing liquid mentioned later on, a very uniform concentration will be possessed, and the edge will be sharp. In addition, image dots having excellent fixing speed and fixation to the printing medium can be obtained. An explanation is given below on the permeation of ink in relation to the printing medium.

In case the permeability of the ink is expressed by the ink amount V per 1 $m^2$, the ink permeation amount V (Unit is milliliter/$m^2$=μm) in time t after the ink droplet is ejected, and it is known that this is expressed by the Bristow method shown below.

$$V=Vr+Ka(t-tw)^{1/2} \text{(here } t>tw\text{)}$$

Immediately after dripping the ink droplet on to the printing medium, most of the ink will be absorbed by the irregular portion (the rough portion on the surface of the printing medium), and hardly any ink will permeate into the printing medium. The time that elapses during this process is tw (wet time), and the absorption amount to the irregular surface at this time is Vr. In case the time after dripping the ink droplet exceeds tw, the permeation amount V increases in proportion to the exceeding time (t–tw) raised to ½ power. Ka is the proportional coefficient of this increased amount, and it shows a value corresponding to the permeation speed.

The Ka value was measured by using the dynamic permeation testing device S for liquid based on the Bristow Method (manufactured by Toyo Seiki Seisakusho). In the present experiment, the PB forms of the present applicant, Canon Inc., were used as the printing medium (printing paper). This PB form is a printing paper that can be used for both the copiers and LBP using electrophotographic system and ink jet printing systems.

Furthermore, we were able to obtain similar results for PPC paper that are used for electronic photo forms of Canon Inc.

The Ka value is determined by the type of surface active agents and the amount added. For instance, by adding a nonionic surface active agent called ethylene oxide-2,4,7,9-tetramethyl-5-decyen-4,7-diol (hereinafter referred to as "Acetylenol", its product name: Manufactured by Kawaken Fine Chemicals), the permeability will be heightened.

In addition, in the case of ink not mixed with Acetylenol (i.e. Contents 0%) the permeability is low, and it possesses the properties of the overlay type ink specified later on. Furthermore, in case the mixing ratio of Acetylenol is 1%, it has a property that will penetrate into the printing medium in a short period of time. In the case of ink having an Acetylenol content of 0.35%, the ink will have a medium property as a semi-permeable ink.

TABLE 2

| | Ka Value (M1/(m2 msec1/2) | Acetylenol Content (%) | Surface Tension (dyne/cm) |
|---|---|---|---|
| Overlay Ink | Less than 1 | 0 or above, less than 0.2 | 40 or above |
| Semi-permeation ink | 1 or above, less than 5.0 | 0.2 or above, less than 0.7 | 35 or above, less than 40 |
| High permeation ink | 5.0 or above | 0.7 or above | Less than 35 |

The above Table 2 shows the Ka Value, Acetylenol Content (%), and Surface Tension (dyne/cm) for "Overlay Ink", "Semi-Permeation Ink", and "Surface Tension", respectively. The permeability of each ink for printing paper that is the printing medium, becomes higher if the Ka value is bigger. In other words, the smaller the surface tension, the higher the permeability.

The Ka values in Table 2 were measured by the dynamic permeation testing device S for liquid based on the Bristow Method (Manufactured by Toyo Seiki Seisakusho) as mentioned above. In the experiment, the aforementioned PB forms of Canon Inc. was used as the printing paper. In addition, the same results were obtained for the PPC forms of the above-mentioned Canon Inc. as well.

In this case, the type of ink specified as "high permeation ink" has an Acetylenol content of 0.7% or above, and it is in the range where favorable results were obtained for the permeability. As the standard of permeability that supports the ink of the present embodiment, it is preferable to make the Ka value of the "overlay type ink" less than 1.0 (ml $m^{-2}$ $msec^{-1/2}$), and in particular, 0.4 0 (ml $m^{-2}$ $msec^{-1/2}$) or less is preferable.

Addition of Dye

To the ink of the above-mentioned embodiment, dye may be further added. In other words, ink to which dye is added to the ink containing the first pigment, the second pigment and dispersing agent for dispersing the second pigment in the water base medium, can form excellent image dot in a short fixing time on the printing medium by the joint usage of processing liquid mentioned later on. Furthermore, the agglomerating force of the Second pigment is alleviated by the existence of the First pigment, but by the addition of dye, the agglomerating force of the Second pigment is alleviated even further, and it is believed that the absorbability of ink can effectively suppress the non-uniformity of the printing image such as "cracking" that easily forms in printing medium having bad absorbability in comparison with ordinary paper. As dyes that can be used in this case, for instance, anionic dyes are given, and preferably a dye having the same polarity as the polarity of group bound to the surface of the First pigment is desirable.

Anionic Dye

As anion dyes that are soluble in the above-mentioned water-based medium that can be used for the present embodiment, well-known acidic dyes, substantivity dyes, and reactive dyes can be suitably used. In particular, it is desirable to use dyes having skeletal structure such as benzidine or trisazo. As dyes to be used, besides the black dyes, within the range that the color tone does not vary significantly, dyes such as cyan, magenta, or yellow may be used.

Amount of Dye to be Added

As for the amount of dyes to be added, from 5 weight % to 60 weight % of the whole coloring materials will be all right, but if the effect of utilizing the mixture of the first pigment and the second pigment effectively, is put into consideration, it is desirable to make the amount less than 50 weight %. Furthermore, in case of ink placing importance on the printing characteristics towards the performance on ordinary paper, it is preferable to make it in the range from 5 weight % to 20 weight %.

(Embodiment of the Processing Liquid)

Next, as an example of the processing liquid that can be used in one of the embodiments of the present invention, for instance, if the group bound to the surface of the First pigment of the above-mentioned ink is an anionic group, a processing liquid that contains a compound containing cationic group that reacts with the anionic group is suitably used.

For instance, as cationic compounds, cationic compounds of rather low molecular weight having about one cationic group in the molecule and cationic compound of rather high molecular weight having a plurality of cationic groups in one molecule can be given. As cationic compounds of rather low molecular weight, there are compounds of the primary or secondary or tertiary amine salt types, concretely speaking, hydrochlorides, acetates, etc. of lauryl amine, palm amine, stearyl amine, rosin amine, etc., and compounds of quaternary ammonium salt type, concretely speaking, lauryl trimethyl ammonium chloride, lauryl dimethyl benzyl ammonium chloride, benzyl tributyl ammonium chloride, benzalkonium chloride, cetyl trimethyl ammonium chloride and further, pyridinium salt type compounds, concretely speaking, cetyl pyridinium chloride, cetyl pyrldinium bromide, etc., and further, there are imidazoline type cationic compounds, concretely speaking, 2-heptadecenyl hydroxy ethylimidazoline, and furthermore, ethylene oxide addition products of secondary alkylamine, concretely speaking, dihydroxy ethyl stearyl amine, etc. can be given as suitable examples.

Furthermore, in the present embodiment, ampholytic surface active agents that show cationic properties in a certain pH range can also be used. As concrete examples, amino acid type ampholytic surface active agents, and compounds of $RNHCH_2$—$CH_2COOH$ type can be given, and as betaine type compounds, for instance, stearyl dimethyl betaine, lauryl dihydryoxy ethyl betaine, etc. can be given. Of course, in case such ampholytic surface active agents are used, it is desirable that either the liquid compositions be adjusted so that the pH becomes lower than their isoelectric points, or in case they are mixed with the ink on the printing medium, adjustments be made so that the pH will be lower than the isoelectric points. Next, as high polymer components of cationic substances, polyaryl amine, polyamine sulfone, polyvinyl amine, chitosan and their neutralized product or semi-neutralized products neutralized with acids such as hydrochloric acid and acetic acid can be given.

As other components that compose the above-mentioned processing liquid, besides the aforementioned cationic substances, water, water soluble organic solvent and other additives may be contained. As water soluble organic solvents amides such as dimethyl formamide, dimethyl acetoamide, etc., ketones such as acetone, ethers such as tetrahydrofuran, dioxane, etc., polyalkylene glycols such as polyethylene glycol, polypropylene glycol, etc., alkylene glycols such as ethylene glycol, propylene glycol, butylenes glycol, triethylene glycol, 1,2,5-hexane triol, thio diglycol, hexylene glycol, diethylene glycol, etc., lower alkyl ethers of polyhydric alcohol such as ethylene glycol methyl ether, diethylene glycol monomethyl ether, triethylene glycol monomethyl ether, etc., and besides monohydric alcohols such as ethanol, isopropyl alcohol, n-butyl alcohol, iso butyl alcohol, etc., glycerol, N-methyl-2-pyrrolidone, 1,3-dimethyl imidazolidinone, triethanol amine, sulfolane, dimethyl sulfoxide, etc. are used. Although there are no special limitations to the contents of the aforementioned water base organic solvent, 5–60 weight % of the total liquid weight, and more preferably, 5–40 weight % of the total liquid weight is a suitable range.

In the present embodiment, to adjust the processing liquid so that it will have high permeability on the printing medium is desirable from the standpoint of aiming at improvement in the fixing speed and fixing properties of the image dots to the printing medium.

By doing so, high speed, high picture quality can be reached with the ordinary paper printing mode. In addition, even in the case printing is done on the high speed absorption paper, the results are as already described.

Permeation property of High Speed Absorption Paper

In the above description, for the explanation of ink permeability, the PPC paper was used as printing medium, but the high speed absorption paper of the present embodiment is different from the PPC paper, and either the sizing agent is not contained, or contains only trace of it. Thus, even in case overlay type ink is used, it will permeate rapidly into the paper, and the Ka value will be 1 (ml $m^{-2}$ $msec^{-1/2}$) or above.

The printing apparatuses of concrete examples for the present invention will be explained in detail by referring to the drawings.

EXAMPLE 1

The present example is a concrete example of the embodiments 1 or 2 of Apparatus Configuration described above.

Figure 4:
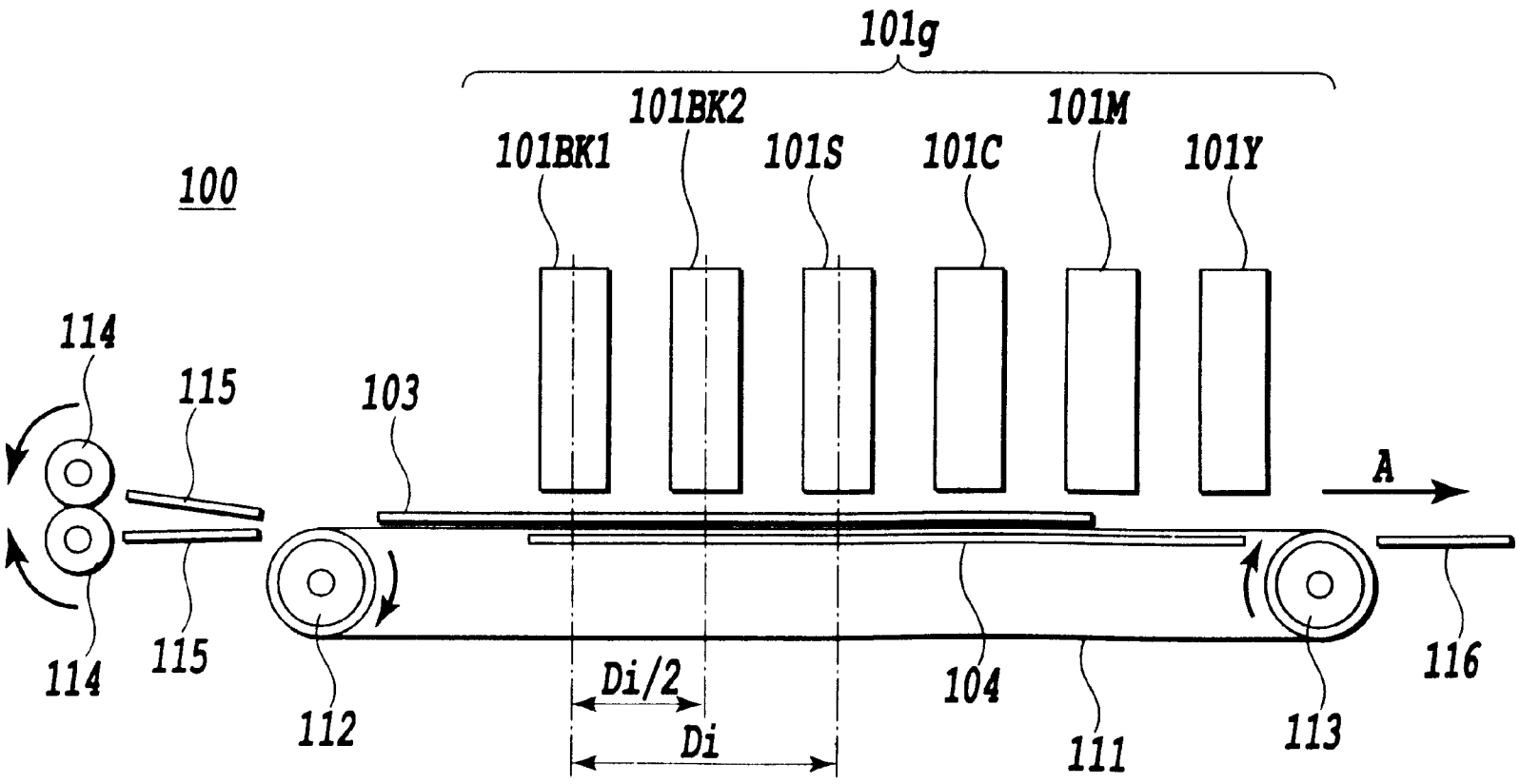
FIG. 4 is a side view showing a schematic structure of a full multi-type printing apparatus according to one embodiment of the present invention.

FIG. 4 is a side view showing a schematic configuration of a full line type printing apparatus related to the present example.

This printing apparatus 100 adopts an ink jet printing system that performs printing by ejecting the ink or the processing liquid from a plurality of full line type printing heads (ejection portions) arranged to the specified positions along the feeding direction (The direction of the arrow "A" in the same drawing) of a printing paper as a printing medium, and it operates under the control of the control circuit shown in FIG. 5 described later on. The printing head of the present embodiment is a system that utilizes heat energy and makes bubbles in the ink or processing liquid, and by the pressure of the bubbles, ejects the ink or the processing liquid.

Each printing head 101Bk, 101Bk2, 101S, 101C, 101M and 101Y of head group 101*g* has about 7200 ink ejection openings arranged in the width direction (a direction perpendicular to the paper of the drawing) of the printing paper being fed in the direction A in the drawing, respectively, and printing can be performed up to printing paper having a maximum size of A3.

A printing paper 103 that is an ordinary paper or a high speed absorption paper is fed in direction A by the rotation of a pair of register rollers 114 driven by a feeding motor, and by a pair of guide plates 115, the paper is guided, and after completing the alignment of the tip register, it is fed by the conveyor belt 111. Conveyor belt 111 that is an endless belt is supported by two rollers 112, 113, and its vertical deviation at the top portion is restricted by the platen 104. By the rotational drive of the rollers 113, the printing paper 103 is fed. Furthermore, the adsorption of the printing paper 103 to the conveyor belt 111 is done by electrostatic adsorption. By the driving source such as the motor which is not illustrated in the drawing, the roller 113 is rotated and driven so that the printing paper 103 is conveyed in the direction of the arrow. The printing paper 103 that is conveyed on the conveyor belt 111, and has undergone printing by the printing head group 101*g* during this period, is discharged on to the stacker 116.

Each printing head in the printing head group 101*g*, has 2 heads 101Bk1, 101Bk2 that ejects black ink described in embodiment 1 of the above-mentioned device composition, processing liquid head 101S that ejects processing liquid, and various color ink heads (Cyan head 101C, Magenta head 101M, Yellow head 101Y) arranged as illustrated along the conveying direction A of the printing paper 103.

Figure 5:
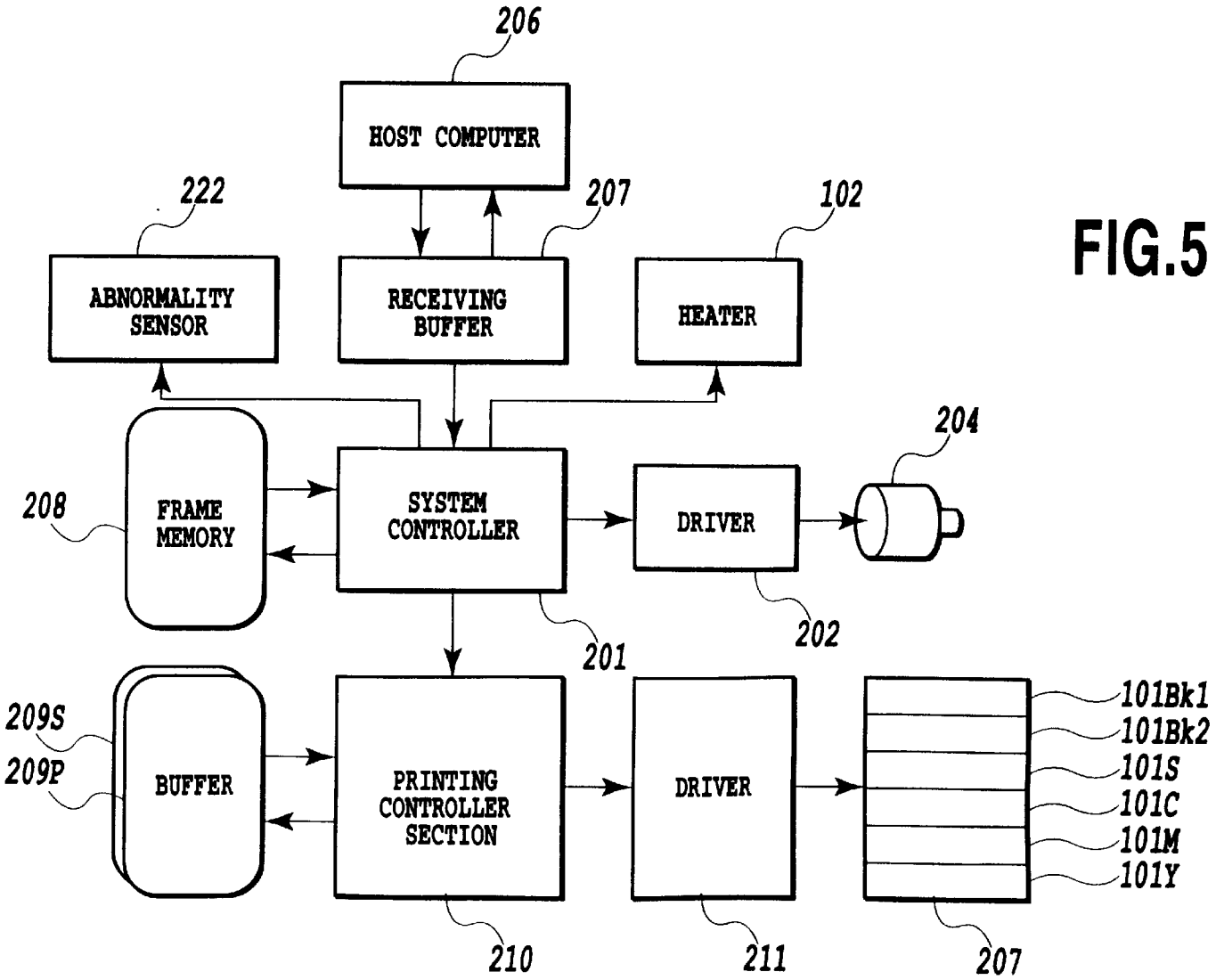
FIG. 5 is a block diagram showing a control configuration of the printing apparatus shown in FIG. 4.

FIG. 5 is a block diagram showing the control configuration of the printing apparatus 100 of the full line type shown in FIG. 4.

A system controller 201 possesses micro-processor as well as ROM that stores control program that is executed by this apparatus, and RAM that is used as work area at the time the micro-processor conducts processing. It executes the control of the whole device. The motor 204 has its drive controlled via a driver 202, and it rotates the roller 113 shown in FIG. 4, and executes feeding of the printing paper. As described before, the relative speed between the printing head and the printing paper is need to be varied according to the printing mode. In this example, a feeding speed of the printing paper is varied and is set at two-stages of speed: 170 mm/sec and 340 mm/sec. More specifically, the system controller 201 sends a signal corresponding to the printing mode to vary the rotational speed of a motor 204 so that the moving speed of the conveyor belt 111 is varied.

A host computer 206 transfers the information to be printed to the printing apparatus 100 of the present example, and controls its printing operation. A receiving buffer 207 temporarily stores the data from the host computer, and it accumulates the data until the reading of the data is performed by the system controller 201. A frame memory 208 is described as a memory that can store data equivalent to one sheet of the printing paper, but the present invention is not limited by the volume of frame memory.

Buffer 209S, 209P are for storing the data to be stored temporarily, and depending on the number of ejection opening of the printing head, the printing volume will change. The printing control section 210 is for adequately controlling the drive of the printing head by the command from the system controller 201, and it controls the drive frequency, printing data, etc., and at the same time, it also prepares data for ejecting the processing liquid. The driver 211 is for conducting the ejection drive of the printing head 101S for ejecting the processing liquid, and the printing heads 101Bk1, 101Bk2, 101C, 101M, and 101Y for ejecting the inks, respectively. And it is controlled by the signals from the printing control section 210.

In the above configuration, printing data from the host computer 206 is transferred to the buffer 207, and stored temporarily. Next, the printing data that is stored, is read by the system controller 201, and developed by buffers 209S, 209P. In addition, jamming of the printing paper, running out of ink, running out of paper, etc. can be detected by various detection signals from abnormality sensors 222.

The printing control section 210 executes preparation of data for the processing liquid in order to eject the processing liquid based on the image data developed by the buffers 209S, 209P. Based on the printing data of each buffer 209S, 209P, and the data for processing liquid, control the ejection operation of each printing head.

As mentioned above, by switching the ordinary printing mode and the high speed printing mode on the printer driver, the ejection amount of the ink and processing liquid can be controlled.

Embodiment 1 of High Speed Absorption Paper

Concrete examples of the high speed absorption paper used in the present example is as follows:

As raw material pulp, LBKP sold on the market underwent beating with double disk refiner and 300 ml of Canadian Standards Freeness (C.S.F.) beaten raw material (A) was obtained. In a similar way, the LBKP sold on the market was beaten with the same equipment as that used for the base layer, and 450 ml of the C.S.F. beaten raw material (B) was obtained. Beaten raw material (A) and beaten raw material (B) were dried and mixed at the weight ratio conversion of 9:1 and the paper making raw material was adjusted.

Hydrated alumina dispersion liquid having solids content concentration of 10 weight % by dispersing hydrated alumina having boehmite structure described in Embodiment 1 of the Japanese Patent Application Laid-open No. 9-99627 was prepared. As cationic resin, Weisstex H-90 (Brand Name, Manufactured by Nagase Chemical Industries, Ltd., Effective components: 45%) was mixed with ion exchange water, and cationic resin dispersion liquid having effective component amount of 10% was prepared. The above mentioned hydrated alumina dispersion liquid and cationic resin dispersion liquid were mixed at the ratio of 1:1 and the on-machine coating liquid was prepared.

By using the above-mentioned paper making raw material, paper adjusted to basis weight of 80 g/m$^2$ was made with Fourdrinier paper machine. With 2 roll size presses, the aforementioned on-machine coating liquid was coated at the rate of 4 g/m$^2$ (Hydrated alumina: 2 g/m$^2$, Cationic resin: 2 g/m$^2$). Furthermore, the surface was made smooth with a super calender and the printing medium was obtained. The feeling was the same as the ordinary paper.

[Other Embodiments of the High Speed Absorption Paper]

As raw material pulp, LBKP sold on the market underwent beating with double disk refiner and 300 ml of Canadian Standards Freeness (C.S.F.) beaten raw material (A) was obtained. In a similar way, the LBKP sold on the market was beaten with the same equipment as that used for 6 the base layer, and 450 ml of the C.S.F. beaten raw material (B) was obtained. Beaten raw material (A) and beaten raw material (B) were dried and mixed at the weight ratio conversion of 9:1 and the paper making raw material was adjusted.

Hydrated alumina dispersion liquid having solids content concentration of 10 weight % by dispersing hydrated alumina having boehmite structure described in Embodiment 1 of the Japanese Patent Application Laid-open No. 9-99627 was prepared. As cationic resin, Weisstex H-90 (Brand Name, Manufactured by Nagase Chemical Industries, Ltd., Effective components: 45%) was mixed with ion exchange water, and cationic resin dispersion liquid having effective component amount of 10% was prepared The above mentioned hydrated alumina dispersion liquid and cationic resin dispersion liquid were mixed at the ratio of 1:1 and the mixed coating liquid was prepared.

Crude rare earth chlorides sold on the market were dispersed in ion exchange water, and water dispersion liquid having solid content concentration of 3 weight % was prepared.

By using the above-mentioned paper making raw material, paper adjusted to basis weight of 80 g/m$^2$ was made with Fourdrinier paper machine. With 2 roll size presses, the aforementioned mixed coating liquid was coated at the rate of 4 g/m$^2$ (Hydrated alumina: 2 g/m$^2$. Cationic resin: 2 g/m$^2$). Next, with the second stage size press equipment, the above-mentioned dispersion liquid of crude rare earth chlorides having a dried solids content conversion of 0.5 g/m$^2$ per one side was coated. Furthermore, the surface was made smooth with a super calender and the printing medium was obtained.

In the present example, regarding the black ink ejected from the heads 101Bk1 and 101Bk2, ink having slow permeation speed (In the present specification, it is also referred to as the overlay type ink) was used, and for the processing liquid and each color of Cyan, Magenta, and Yellow ejected from the heads 101S, 101C, 101M, and 101Y, high permeation speed processing liquid and inks (hereinafter referred to as high permeation ink in the present embodiment) were used.

The compositions of the processing liquid and each ink used in the present example are as follows. In addition, the mixing rate of each component is shown in weight parts.

| | |
|---|---|
| [Processing Liquid] | |
| Glycerol | 7 parts |
| Diethylene glycol | 5 parts |
| Acetylenol EH (Manufactured by Kawaken Fine Chemical) | 2 parts |
| Polyaryl amine (Molecular Wt. 1500 or less, Average Value about 1000) | 4 parts |
| Acetic Acid | 4 parts |
| Benzalkonium chloride | 0.5 parts |
| Triethylene glycol monobutyl ether | 3 parts |
| Water | Remainder |
| [Yellow (Y) Ink] | |
| C. I. Direct Yellow 86 | 3 parts |
| Glycerol | 5 parts |
| Diethylene glycol | 5 parts |
| Acetylenol EH (Manufactured by Kawaken Fine Chemical) | 1 part |
| Water | Remainder |
| [Magenta (M) Ink] | |
| C. I. Acid Red 289 | 3 parts |
| Glycerol | 5 parts |
| Diethylene glycol | 5 parts |
| Acetylenol EH (Manufactured by Kawaken Fine Chemical) | 1 part |
| Water | Remainder |
| [Cyan (C) Ink] | |
| C. I. Direct Blue 199 | 3 parts |
| Glycerol | 5 parts |
| Diethylene glycol | 5 parts |
| Acetylenol EH (Manufactured by Kawaken Fine Chemical) | 1 part |
| Water | Remainder |
| [Black (Bk) Ink] | |
| Pigment Dispersion Liquid 1 | 25 parts |
| Pigment Dispersion Liquid 2 | 25 parts |
| Glycerol | 6 parts |

-continued

| | |
|---|---|
| Diethylene glycol | 5 parts |
| Acetylenol EH (Manufactured by Kawaken Fine Chemical) | 0.1 part |
| Water | Remainder |

Furthermore, the Ka value of this black ink was 0.33. The above-mentioned pigment dispersion liquids 1 and 2 comprise the following.

Pigment Dispersion Liquid 1

After mixing log of carbon black of which the surface area is 230 $m^2/g$ and the DBP oil absorption amount is 70 ml/100 g and 3.41 g of p-amino benzoic acid and 72 g of water, 1.62 g of nitric acid was dropped into it and agitated at 70° C. After several minutes elapsed, a solution made by adding 1.07 g of sodium nitrite to 5 grams of water was added, then further agitated for 1 hour. The slurry that was obtained was filtered with Toyo Filter No. 2 (Manufactured by Advantis Corp.), the pigment particles were thoroughly washed, and after drying them in an oven at 90° C., water was added to the pigment, and aqueous pigment solution having a pigment concentration of 10 weight % was prepared. By the above-mentioned method, as illustrated by the following chemical formula, a pigment dispersion liquid in which self-dispersing type carbon black that is anionically charged by binding hydrophilic group via phenyl group to its surface, was obtained.

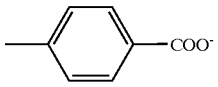

Pigment Dispersion Liquid 2

The pigment dispersion liquid 2 was prepared in the following manner As dispersing agent, 14 parts of styrene-acrylic acid-ethyl acrylate copolymer (Acid Value: 180, Average Molecular Weight: 12000) and 4 parts of monoethanol amine and 72 parts of water were mixed, then after heating at 70° C. in a water bath, the resin was :dissolved completely. At this time, if the concentration of the resin is low, sometimes the resin will not dissolve completely. Thus, at the time of dissolving the resin, high concentration solution is prepared beforehand, and the desired resin concentration may be prepared by dilution. To this solution, add 10 parts of carbon black (Trade Name: MCF-88, pH 8.0 Manufactured by Mitsubishi Chemical Corp.) that cannot be dispersed in water base medium until the dispersing agent acts on it. Subsequently, premixing was performed for 30 minutes under the following conditions. Next, the following operation was performed, and pigment dispersion liquid No. 2 in which carbon black (MCF-88) was dispersed in water base medium by the action of dispersing agent, was obtained.

Dispersing Machine: Side Grinder (Manufactured by Igarashi Equipment Co.)

Grinding Medium; Zirconia Beads Diameter: 1 mm

Filling Rate of Grinding Medium: 50% (Volume)

Grinding Time: 3 hours

Centrifuge Treatment; 12000 RPM, 20 minutes

By using the ink of the carbon black based on the above-mentioned present embodiment, the self-dispersion type carbon black, and carbon black that can be dispersed by the use of high polymer dispersing agent, and high polymer dispersing agent were mixed, and against the ink that is dispersed, processing liquid containing 2 types of cationic compounds having opposite polarity (polyaryl amine, benzalkonium chloride) was made to react.

In the present embodiment, the ink ejecting openings of each printing head are aligned at a density of 600 dpi, and printing will be performed in the conveying direction of the printing paper at a dot density of 600 dpi. By doing so, the dot density of images that are recorded by the present embodiment will become 600 dpi in both the row direction and the column direction. In addition, the discharge frequency of each head was made 8 KHz, and a composition in which a 2 droplet ejection is possible for one pixel of 600 DPI was made. Therefore, under normal printing mode, the conveying speed of the printing paper will be about 170 mm/sec.

In a high speed printing mode, the ejection frequency of the head remains at 8 KHz, but by making a composition in which 1 droplet ejection is made for one pixel of 600 DPI, the feeding speed of the printing paper is set to about 340 m/sec.

The ejection amount of each printing head was set as 8 pl. In the case of using 2 heads, Bk1 and Bk2 are used in the normal printing mode assumed for the ordinary paper, the total amount of ink ejected per one pixel of 600 DPI is about 20 pl. In the case of color this becomes about 16 pl per one pixel of 600 DPI. On the other hand, in the high speed printing mode, in the case of using 2 heads Bk1 and Bk2 are used, the average total ejection amount per one pixel will be about 12 pl. In the case of color, this becomes about 8 pl per one pixel of 600 DP.

The full multi-type printing apparatus described above is used in state in which the printing head is fixed in the printing operation, and since the time required for feeding the paper is approximately the same as the time required for the printing, in particular, it is suitable for high speed printing. Therefore, by applying this invention to such a high speed printing apparatus, the high speed printing function can be improved even more, and in addition, it makes possible the printing of high quality images which have high OD value, with no bleeding or haze.

The printing apparatus of the present example is most generally used as a printer, but needless to say, it need not be restricted to this, and can be composed as printing portion for copying machine and facsimiles.

[Examples of Other Inks (Pigment-Dye Ink)]

Components of the processing liquid and the Bk ink related to other examples used in the present invention are as follows. The ratio of each component is shown in weight parts.

| [Processing Liquid] | |
|---|---|
| Glycerol | 7 parts |
| Diethylene glycol | 5 parts |
| Acetylenol EH (Manufactured by Kawaken Fine Chemical) | 0.7 parts |
| Polyaryl amine (Molecular Wt. 1500 or less, Average Value about 1000) | 4 parts |
| Acetic Acid | 4 parts |
| Benzalkonium chloride | 0.5 parts |
| Triethylene glycol mono-butyl ether | 3 parts |
| Water | Remainder |
| [Mixed. Ink of Black (Bk)] | |
| Pigment Dispersing Liquid | 25 parts |
| Food Black 2 | 2 parts |
| Glycerol | 6 parts |

-continued

| | |
|---|---|
| Triethylene glycol | 5 parts |
| Acetylenol EH (Manufactured by Kawaken Fine Chemical) | 0.1 parts |
| Water | Remainder |

The Ka value of the mixed ink of this black carbon was 0.33. Furthermore, the above-mentioned dispersing liquid consists of the following.

[Pigment Dispersing Liquid]

To the solution to which 5 g of concentrated hydrochloric acid is added to 53 g of water, 1.58 g of anthranilic acid was added. By keeping this solution below 10° C. at all times by agitating it in an ice bath, a solution prepared by adding 1.78 g of anthorium nitrite to 8.7 g of water at 5° C., was added. After agitating it further for 15 minutes, 20 g of carbon black of which the surface area is 320 $m^2/g$ and the DBP oil absorption amount is 120 ml/100 g, was added in the mixed state. Later on, it was agitated for another 15 minutes. The slurry that was obtained was filtered with Toyo filter paper No. 2 (Manufactured by Advantis Corp.), and after washing the pigment particles thoroughly, they were dried in an oven set at 110° C. Subsequently, water was added to the pigments, and a pigment solution having a pigment concentration of 10 weight % was prepared. By the above mentioned method, as illustrated by the following chemical formula, a pigment dispersion liquid in which self-dispersing type carbon black that is anionically charged by binding hydrophilic group via phenyl group to its surface, was obtained.

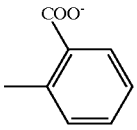

As it is clear from each component, depending on the content of the Acetylenol, the pigment and dye inks of black are set to the overlay type ink, respectively, and the processing liquid and each ink of C, M. Y a-re Set to the high permeability ink, respectively.

EXAMPLE 2

The present example is related to another concrete example of the embodiment 1 or 2 of the above-mentioned apparatus configuration.

Figure 6:
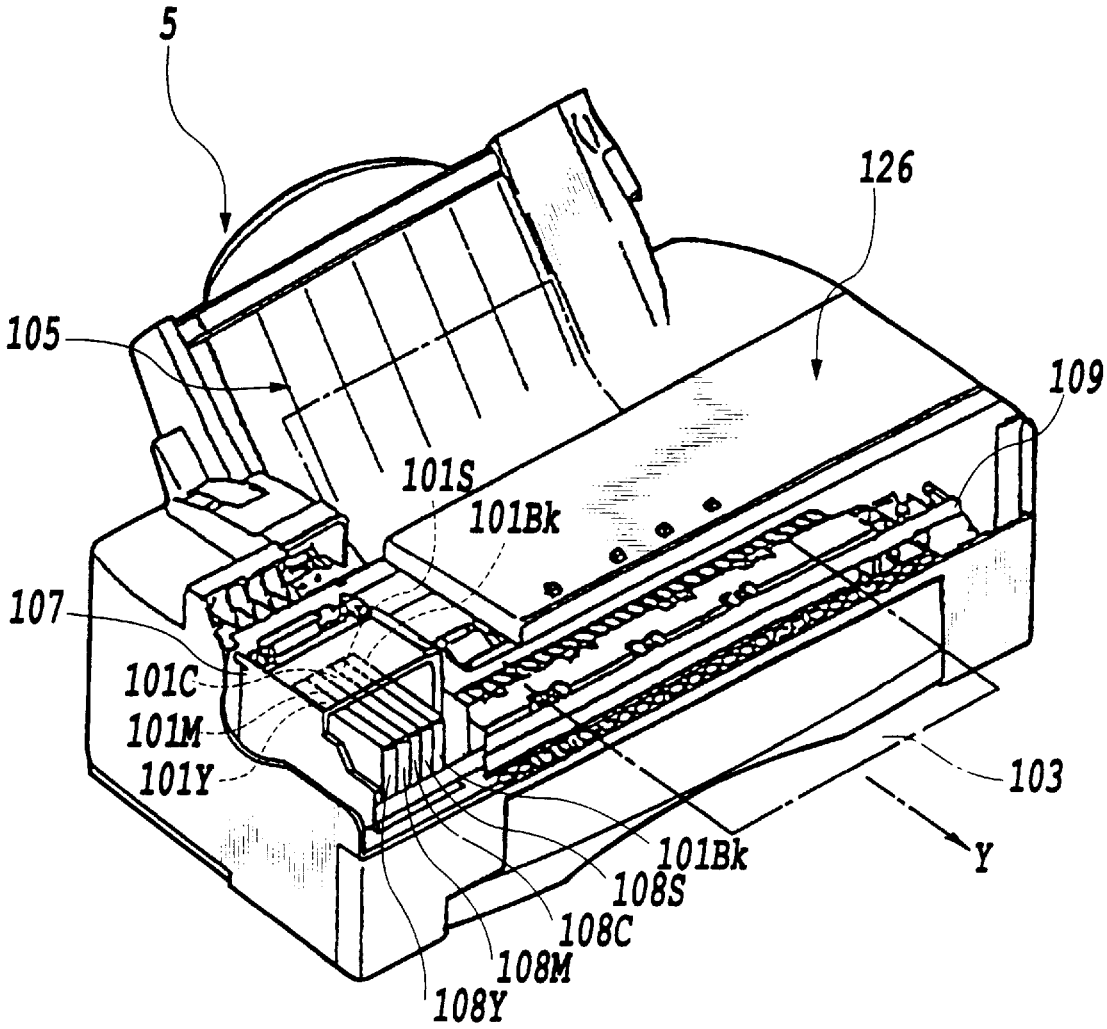
FIG. 6 is a perspective view showing a structure of a serial type printing apparatus according to other embodiment of the present invention.

FIG. 6 is a schematic perspective view showing the configuration of a serial type printing apparatus 5 related to a second example of the present invention. More specifically, the printing apparatus in which after ejecting the ink to the printing medium, the processing liquid is ejected to react with the ink, can be realized not only as the above-mentioned full line type apparatus but also as a serial type apparatus, apparently. Furthermore, in the case the elements shown in FIG. 4 are similar elements, the same reference signs are given and detailed explanation will be omitted here.

The printing paper 103 that is a printing medium, is inserted from the paper feeding section 105 and after passing through the printing section 126, it is discharged. In the present example, a moderately priced ordinary paper that is broadly used in general and a high speed absorption paper are used as printing paper 103. In the printing section 126, a carriage 107 is loaded with printing heads 101Bk, 101S, 101C, 101M, and 101Y. By the driving force of the motor which is not illustrated, it is structured so that reciprocal movement is possible along the guide rail 109. The printing head Bk ejects the mixed ink of carbon black explained in the above-mentioned embodiments. Furthermore, in the printing heads 101S, 101C, 101M, and 101Y, processing liquid, cyan ink, magenta ink, and yellow ink are ejected, respectively, and it is driven so that the inks or processing liquid are ejected to the printing paper 103 in this order.

To each head, from ink tanks 108Bk, 108S, 108C, 108M, and 108Y corresponding to each tank, ink or processing liquid is fed. At the time of ejecting the ink or ejecting the processing liquid, driving signals are supplied to the electrothermal converting element or the heater, which is provided for each ejection opening, in each head. Thereby, generated thermal energy is acted upon the ink or the processing liquid, and bubbles are generated, so that by utilizing the pressure formed at the time the bubbles are generated, the ejection of the ink or the processing liquid is executed. In each head, 64 ejection openings are provided at density of 360 dpi. These openings are aligned almost in the same direction as the feeding direction Y of the printing paper 103. In other words, they are aligned almost perpendicularly to the scanning direction of each head.

The head has two heaters of large and small, arranged corresponding to one ejection opening (nozzle), and with the drive of only the small heater 10 pl of the droplet is ejected, and when both large and small heaters are driven 25 pl of droplet is ejected. Thus, the amount of ejection per each ejection opening is 10–25 pl.

The printing density in the scanning direction is 720 DPI. At normal printing mode, ejection is performed at 25 pl, and at high speed printing mode, ejection is performed at 10 pl.

In the case printing is performed with 25 pl of droplet volume, a ejection frequency is set at 7.2 KHz. On the other hand, in the case of the high speed printing mode in which the droplet volume is set at 10 pl printing operation is executed with driving frequency being set at 14.4 KHz and the scanning speed of the printing heads being set at twice the speed during the normal printing mode. As for the ink ejection amount, it is the same as that explained in the example of the printing mode, and by the printing mode, the ejection amount of 1 droplet is achieved by changing the ejection amount by the method described above.

EXAMPLE 3

The present example is related to the concrete example of embodiment 3 of the above-mentioned apparatus configuration.

In the present example, the serial type printing apparatus shown in FIG. 6, is not provided with the processing liquid head. Therefore, it is an example in which a total of four heads are used. That is, the printing apparatus in which Bk ink is ejected to the printing medium and then color ink is ejected to be made reacted with the Bk ink, can be realized not only as the full line type but also as the serial type as well.

Explanation will be given by referring to FIG. 6 below. The printing paper 103 as the printing medium is inserted from the feeding section 105 and discharged via the printing section 126. In the present example as well, the moderately priced ordinary paper broadly used in general and the high speed absorption paper are used as the printing paper 103. In the printing section 126, the carriage 107 is loaded with printing head 101Bk, 101C, 101M, and 101Y, and by the driving force of the motor that is not illustrated, it is structured so that reciprocal movement is possible along the guide rail 109. The printing head 101Bk ejects the pigment ink. Furthermore, printing heads 101C, 101M, 101Y eject cyan ink, magenta ink, and yellow ink, respectively, and it is driven so that the ink will be ejected to the printing paper in this order.

Ink is fed to each head from the ink tanks 108Bk, 108C, 108M, and 108Y corresponding to the respective heads, and at the time of ejecting the ink, drive signal is supplied to the electro-thermal converter or the heater provided in each ejection opening of each head. Thereby, thermal energy is made to act on the ink, and generate bubbles. The pressure formed at the time the bubbles are generated are utilized for ejecting the ink. To each head, 64 ejection openings are provided at a density of 600 dpi, respectively. They are aligned in almost the same direction as the feeding direction Y of the printing paper 103, that is, aligned in a direction approximately perpendicular to the scanning direction of the head.

Black characters are printed independently with using the Bk head, and the solid image of black is printed by overlapping the Bk ink and the color ink having reactivity to each other, printing is performed. The amount of ink ejected to the paper is approximately the same as that explained in the embodiment of the printing mode with the exception of the printing in which considerable thinning is performed such as the amount of color ink to react with the Bk ink being 15% or less.

That is, in the normal printing mode, for one pixel of 600 DPI, 2.5 droplets of Bk ink each one droplet having 8 pl of volume are ejected, and in the case that color ink is overlapped, 0.1 droplet (10%) of 8 pl droplet is ejected. On the other hand, in the case of high speed printing mode (high speed absorption paper printing mode), 1.5 droplets of the Bk ink are ejected to one pixel of 600 DPI, and for the color ink, the same as the embodiment of the printing mode.

Example 4

The present example may have the same configuration as the head described in the aforementioned example 3, and in this case, the head is the same as that of BJ F850 manufactured by Canon Inc. Alternatively, configuration of the head may be that shown in FIG. 7.

An explanation will be given below by referring to FIG. 6. The printing paper 103 as the printing medium is inserted from the paper feeding section 105, and via the printing portion 126 discharged. In the present example also the moderately priced ordinary paper broadly used in general and the high speed absorption paper are used as the printing paper 103. In the printing section 126, the carriage 107 is loaded with printing heads 101Bk, 101C, 101M, and 101Y, and structured so that reciprocal movement along the guide rail 109 becomes possible by the driving force of the motor that is not illustrated. The printing head 101Bk ejects the black ink described in the above-mentioned embodiments. Furthermore, from the printing heads 101C, 101M, and 101Y, cyan ink, magenta ink, and yellow ink are ejected, respectively, and they are driven so that the inks are ejected to the printing paper 103 in this order.

To each head, from ink tanks 108Bk, 108C, 108M, and 108Y corresponding to each, inks are fed, and at the time of ejecting ink, driving signals are supplied to the electro-thermal converter or the heater installed to each ejection opening of each head. Thereby, thermal energy is acted upon the ink, and bubbles are generated. By utilizing the pressure formed at the time the bubbles are generated, the ejection of the ink is performed. To each head, 128 ejection openings with density of 1200 dpi are provided. In the case of the Bk head, 128 ejection openings are provided. These openings are aligned almost in the same direction as the feeding direction Y of the printing paper 103. In other words, they are aligned almost perpendicularly to the scanning direction of each head.

Figure 7:
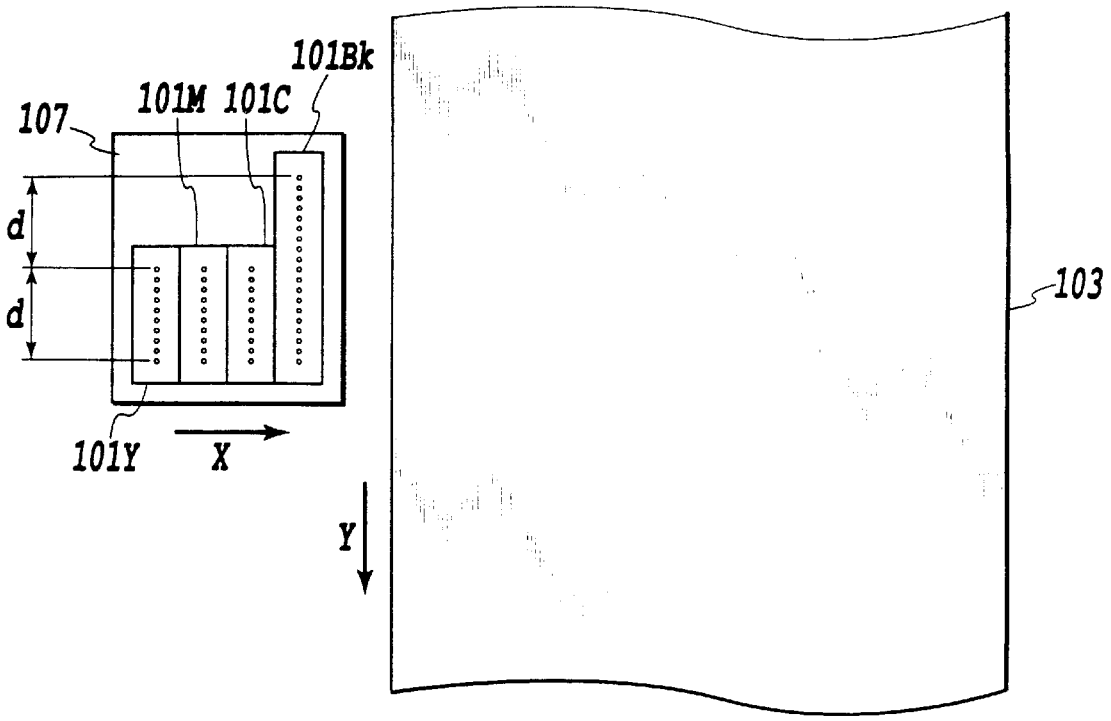
FIG. 7 is a front view showing a printing head arrangement of a serial type printing apparatus according to further embodiment of the present invention.

In the case of adopting the head configuration shown in FIG. 7, the Bk head is longer than each of the color heads, and in the case that independent black image is printed, all nozzles of the Bk head are used for the printing. In the case of printing images in which Bk and color inks are mixed, by using the upper half of the nozzles of the black ink head 101BK in FIG. 7, the printing of the color ink will have as time lag in comparison with the printing of Bk ink. Therefore, even if there is no reactivity between the Bk ink and the color ink, the bleeding of Bk ink and color ink becomes slight.

As for the amount of ink to be ejected to the paper, it is as follows. The ejection amount for Bk ink, color ink is 4 pl. In the ordinary printing mode, both for Bk and color inks, 1 droplet per pixel of 1200 DPI, in other words, when converted to one pixel of 600 DPI, it will be 4 droplets, 16 pl. On the other hand, in the case of high speed printing mode. Bk is 3 droplets per pixel of 600 DPI, that is, 12 pl is ejected, and in the case of color, 2 droplets per pixel of 600 DPI, that is, 8 pl is ejected.

Figure 8:
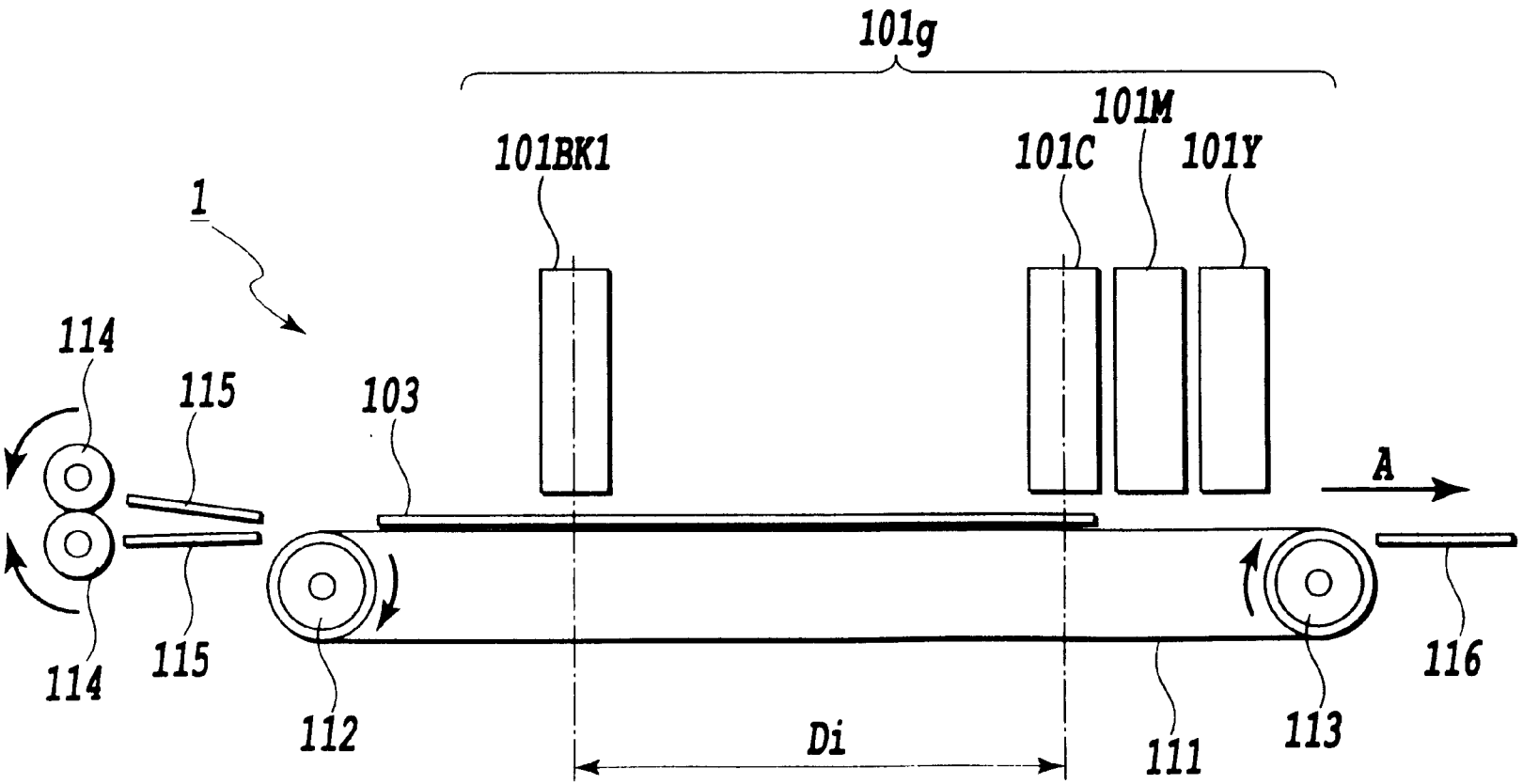
FIG. 8 is a side view showing a structure of full multi type printing apparatus according to still further embodiment of the present invention.

In addition, FIG. 8 shows printing apparatus of the full multi-type using 4 printing heads of C, M, Y and Bk similarly to example shown in FIG. 7.

As it is evident from the above explanation, according to the embodiments of the present invention, when executing the plurality of printing modes having different relative movement speeds, respectively, in the printing mode with higher relative movement speed, the amount of ink ejected per one pixel is made smaller than that in the printing mode with lower relative movement speed. In addition to this, at least in the case of printing black, black ink and a processing liquid that makes the black ink insoluble are ejected from the printing head. Preferably, in the printing mode with higher relative movement speed, a printing medium containing substantially no sizing agent but containing alumina particles, or a printing medium having a permeableness of 5 ml $m^{-2}$ $msec^{-1/2}$ or above for Ka value in a condition of using ink having a permeability to PPC paper of 1 ml $m^{-2}$ $msec^{-1/2}$ or less for Ka value, that is, a high speed absorption paper is used. Thereby, even when the amount of ink landing to the printing medium is small, most of the ink coloring material will be retained on the surface layer of the printing medium, and the solvent of the ink will permeate rather rapidly. Consequently, the above printing mode can realize printing with high density and high speed. On the other hand, even when the above-mentioned high speed absorption paper is not used but the printing paper such as ordinary paper is used, since the processing liquid that makes the ink insoluble is used, similar to the above case, a lot of coloring material can be retained on the surface layer of the printing medium, and a printing having high density can be achieved.

As a result, an apparatus which enables high speed and high density printing and is user-friendly can be provided.

What is claimed is:

1. An ink jet printing apparatus, which performs printing by executing relative movement of a printing head to a printing medium and ejecting at least ink from the printing head during the relative movement, performing printing in a printing mode selected from a plurality of printing modes which correspond to different printing mediums and have different relative movement speeds of the printing head to the printing medium, respectively, said apparatus comprising:

head driving means for controlling the printing head to execute ejection in a manner that for a printing mode having a high relative movement speed, an ink ejection amount per one pixel is made smaller than that in a printing mode having a lower relative movement speed than the high relative movement speed, and that for the printing mode having the high relative movement speed, ink and a processing liquid that makes the ink insoluble are ejected.

2. An ink jet printing apparatus as claimed in claim 1, wherein the printing mode having the high relative movement speed is used with a printing medium that contains substantially no sizing agent but contains alumina particles.

3. An ink jet printing apparatus claimed in claim 1, wherein the printing mode having the high relative movement speed is used with a printing medium having a permeability of 5 ml $m^{-2}$ $msec^{-1/2}$ or more as a Ka value in a case of using ink having a permeation property of 1 ml $m^{-2}$ $msec^{-1/2}$ or less as a Ka value for PPC paper.

4. An ink jet printing apparatus as claimed in claim 1, further comprising a printing head that utilizes thermal energy and forms bubbles in the ink to eject the ink by pressure of the bubbles.

5. An ink jet printing apparatus, comprising:

a controller that can execute a high speed absorption paper printing mode for use with a high speed absorption paper, which contains substantially no sizing agent but contains alumina particles or which has a permeability of 5 ml $m^{-2}$ $msec^{-1/2}$ or more as a Ka value in a case of using ink having a permeation property of 1 ml $m^{-2}$ $msec^{-1/2}$ or less as a Ka value for PPC paper, and an ordinary paper printing mode for use with ordinary paper, respectively, as the printing mode, wherein an ink ejection amount per one pixel for the high speed absorption paper printing mode is less than that for the ordinary paper printing mode.

6. An ink jet printing apparatus as claimed in claim 5, wherein the high speed absorption paper printing mode has a relative movement speed of the printing medium to the printing head higher than that of the ordinary paper printing mode.

7. An ink jet printing apparatus as claimed in claim 5, wherein the high speed absorption paper printing mode executes printing of black by mixing black ink and another liquid that reacts with the black ink.

8. An ink jet printing apparatus as claimed in claim 5, wherein the high speed absorption paper printing mode includes at least two printing modes wherein one of the modes performs printing of black by mixing black ink with another liquid that reacts with the black ink, and the other mode performs printing of black with black ink alone.

9. An ink jet printing apparatus as claimed in claim 5, wherein black ink has a permeation property of a Ka value less than 1 ml $m^{-2}$ $msec^{-2}$ to the ordinary paper.

10. An ink jet printing apparatus as claimed in claim 5, wherein black ink contains a pigment.

11. An ink jet printing apparatus as claimed in claim 5, wherein the ordinary paper printing mode executes printing based on ink droplets of a predetermined size and the high speed absorption paper printing mode executes printing based on ink droplets of a size smaller than the predetermined size.

12. An ink jet printing apparatus as claimed in claim 11, further comprising a printing head that can eject the same ink as a large droplet and a small droplet.

13. An ink jet printing apparatus, wherein an ink ejection amount per one pixel is $2.8\times10^{-3}$ pl/$\mu m^2$–$8.4\times10^{-3}$ pl/$\mu m^2$ onto a printing medium having a permeability of 5 ml $m^{-2}$ $msec^{-1/2}$ or more as a Ka value in a case of using ink having a permeation property of 1 ml $m^{-2}$ $msec^{-1/2}$ or less as a Ka value for PPC paper.

14. An ink jet printing apparatus as claimed in claim 13, wherein the ink ejection amount per one pixel of color ink is $2.2\times10^{-3}$ pl/$\mu m^2$–$5.6\times10^{-3}$ pl/$\mu m^2$ onto the printing medium.

15. An ink jet printing apparatus that performs printing by ejecting ink to a printing medium, wherein an ink ejection amount per one pixel is $2.8\times10^{-3}$ pl/$\mu m^2$–$8.4\times10^{-3}$ pl/$\mu m^2$ onto a printing medium that contains substantially no sizing agent but contains alumina particles.

16. An ink jet printing method, which performs printing by executing relative movement of a printing head to a printing medium and ejecting at least ink from the printing head during the relative movement, performing printing in a printing mode selected from a plurality of printing modes which correspond to different printing mediums and have different relative movement speeds of the printing head to the printing medium, respectively, said method comprising the step of:

controlling the printing head to execute ejection in a manner that for a printing mode having a high relative movement speed, an ink ejection amount per one pixel is made smaller than that in a printing mode having a lower relative movement speed than the high relative movement speed, and that for the printing mode having the high relative movement speed, ink and a processing liquid that makes the ink insoluble are ejected.

17. An ink jet printing method as claimed in claim 16, wherein the printing mode having the high relative movement speed is used with a printing medium that contains substantially no sizing agent but contains alumina particles.

18. An ink jet printing method as claimed in claim 16, wherein the printing mode having the high relative movement speed is used with a printing medium having a permeability of 5 ml $m^{-2}$ $msec^{-1/2}$ or more as a Ka value in a case of using ink having a permeation property of 1 ml $m^{-2}$ $msec^{-1/2}$ or less as a Ka value for PPC paper.

19. An ink jet printing method as claimed in claim 16, wherein said printing step is performed with a printing head that utilizes thermal energy and forms bubbles in the ink to eject the ink by pressure of the bubbles.

20. An ink jet printing method, comprising:

a printing step for executing a high speed absorption paper printing mode for use with a high speed absorption paper, which contains substantially no sizing agent but contains alumina particles or which has a permeability of 5 ml $m^{-2}$ $msec^{-1/2}$ or more as a Ka value in a case of using ink having a permeation property of 1 ml $m^{-2}$ $msec^{-1/2}$ or less as a Ka value for PPC paper, and an ordinary paper printing mode for use with ordinary paper, respectively, as the printing mode, wherein an ink ejection amount per one pixel for the high speed absorption paper printing mode is less than that for the ordinary paper printing mode.

21. An ink jet printing method as claimed in claim 20, wherein the high speed absorption paper printing mode has a relative movement speed of the printing medium to the printing head higher than that of the ordinary paper printing mode.

22. An ink jet printing method as claimed in claim 20, wherein the high speed absorption paper printing mode executes printing of black by mixing black ink and another liquid that reacts with the black ink.

23. An ink jet printing method as claimed in claim 20, wherein the high speed absorption paper printing mode includes at least two printing modes wherein one of the modes performs printing of black by mixing black ink with another liquid that reacts with the black ink, and the other mode performs printing of black with black ink alone.

24. An ink jet printing method as claimed in claim 20, wherein black ink has a permeation property of a Ka value less than 1 ml $m^{-2}$ $msec^{-1/2}$ to the ordinary paper.

25. An ink jet printing method as claimed in claim 20, wherein black ink contains a pigment.

26. An ink jet printing method as claimed in claim 20, wherein the ordinary paper printing mode executes printing based on ink droplets of a predetermined size and the high speed absorption paper printing mode executes printing based on ink droplets of a size smaller than the predetermined size.

27. An ink jet printing method as claimed in claim 26, wherein said printing step is performed with a printing head that can eject the same ink as a large droplet and a small droplet.

28. An ink jet printing method, wherein an ink ejection amount per one pixel is $2.8\times10^{-3}$ pl/$\mu m^2$–$8.4\times10^{-3}$ pl/$\mu m^2$ onto a printing medium having a permeability of 5 ml $m^{-2}$ $msec^{-1/2}$ or more as a Ka value in a case of using ink having a permeation property of 1 ml $m^{-2}$ $msec^{-1/2}$ or less as a Ka value for PPC paper.

29. An ink jet printing method as claimed in claim 28, wherein the ink ejection amount per one pixel of color ink is $2.2\times10^{-3}$ pl/$\mu m^2$–$5.6\times10^{-3}$ pl/$\mu m^2$ onto the printing medium.

30. An ink jet printing method that performs printing by ejecting ink to a printing medium, wherein an ink ejection amount per one pixel is $2.8\times10^{-3}$ pl/$\mu m^2$–$8.4\times10^{-3}$ pl/$\mu m^2$ onto the printing medium that contains substantially no sizing agent but contains alumina particles.

* * * * *

UNITED STATES PATENT AND TRADEMARK OFFICE

CERTIFICATE OF CORRECTION

PATENT NO. : 6,582,047 B2
DATED : June 24, 2003
INVENTOR(S) : Koitabashi et al.

It is certified that error appears in the above-identified patent and that said Letters Patent is hereby corrected as shown below:

Column 1,
Line 27, “ink” should read -- the link --.

Column 11,
Line 29, “the” (second occurrence) should be deleted.

Column 12,
Line 31, “are” should be deleted.

Column 16,
Line 28, “landing;” should read -- landing: --.
Line 29, “droplet” should read -- droplet, --.
Line 43, “the ordinary” should read -- ordinary --.

Column 21,
Line 62, “to” should be deleted.

Column 22,
Line 27, “volume” should read -- a volume --.

Column 23,
Line 15, “inclued,” should read -- include, --.

Column 26,
Line 60, “the” should be deleted and “system” should read -- systems --.

Column 34,
Line 32, “state” should read -- a state --.

Column 38,
Line 10, “independent” should read -- an independent --.
Line 14, “as” should read -- a --.

UNITED STATES PATENT AND TRADEMARK OFFICE

CERTIFICATE OF CORRECTION

PATENT NO. : 6,582,047 B2
DATED : June 24, 2003
INVENTOR(S) : Koitabashi et al.

It is certified that error appears in the above-identified patent and that said Letters Patent is hereby corrected as shown below:

Column 39,
Line 56, "1 ml $m^{-2}$ msec $^{-2}$" should read -- 1 ml $m^{-2}$ msec $-^{1/2}$ --.

Signed and Sealed this

First Day of June, 2004

JON W. DUDAS
*Acting Director of the United States Patent and Trademark Office*